US009293826B2

(12) United States Patent
Yonei et al.

(10) Patent No.: US 9,293,826 B2
(45) Date of Patent: Mar. 22, 2016

(54) PLANAR INVERTED F ANTENNA WITH IMPROVED FEEDING LINE CONNECTION

(75) Inventors: Yoshiyuki Yonei, Chiba (JP); Masahiro Sobu, Chiba (JP); Akinori Matsui, Fukaya (JP); Misao Haneishi, Saitama (JP)

(73) Assignees: SEIKO SOLUTIONS INC. (JP); CHIKOUJI GAKUEN EDUCATIONAL FOUNDATION (JP); Misao Haneishi (JP)

( * ) Notice: Subject to any disclaimer, the term of this patent is extended or adjusted under 35 U.S.C. 154(b) by 79 days.

(21) Appl. No.: 14/240,127

(22) PCT Filed: Aug. 10, 2012

(86) PCT No.: PCT/JP2012/070455

§ 371 (c)(1),
(2), (4) Date: Feb. 21, 2014

(87) PCT Pub. No.: WO2013/031518

PCT Pub. Date: Mar. 7, 2013

(65) Prior Publication Data

US 2014/0210674 A1 Jul. 31, 2014

(30) Foreign Application Priority Data

Aug. 26, 2011 (JP) ..... 2011-185317

(51) Int. Cl.
*H01Q 9/46* (2006.01)
*H01Q 9/04* (2006.01)
*H01Q 5/371* (2015.01)

(52) U.S. Cl.
CPC ..... *H01Q 9/0407* (2013.01); *H01Q 5/371* (2015.01); *H01Q 9/045* (2013.01); *H01Q 9/0421* (2013.01); *H01Q 9/0471* (2013.01)

(58) Field of Classification Search
CPC ... H01Q 9/0421; H01Q 9/0407; H01Q 9/045; H01Q 9/0471; H01Q 9/42; H01Q 1/243; H01Q 1/273; H01Q 1/38; H01Q 1/40; H01Q 5/364; H01Q 5/371
USPC ..... 343/700 MS, 845, 848, 718, 702
See application file for complete search history.

(56) References Cited

U.S. PATENT DOCUMENTS 6,229,487 B1 * 5/2001 Sadler et al. ..... 343/700 MS
6,423,915 B1 * 7/2002 Winter ..... 200/292

(Continued)

FOREIGN PATENT DOCUMENTS

EP 1026774 8/2000
JP 05299929 11/1993

(Continued)

OTHER PUBLICATIONS

International Search Report mailed Sep. 25, 2012 issued in International Appln. No. PCT/JP2012/070455.

(Continued)

*Primary Examiner* — Lam T Mai
(74) *Attorney, Agent, or Firm* — Adams & Wilks

(57) ABSTRACT

A planar inverted F antenna has a ground conductive plate and a main conductive plate that are short-circuited by a short circuit member. The main conductive plate connects to a feeding line for feeding power to the antenna and includes opposite side ends, a base extending from one side end to a prescribed position in the direction toward the other side end, and at least one slit extending from the other side end up to the prescribed position to form a microstrip line to which the feeding line is connected and at least one excitation conductive plate spaced apart from the microstrip line. Power is supplied to a feeding point at the prescribed position from the feeding line via the microstrip line which has a width selected so that both an input impedance of the antenna at the feeding point and a characteristic impedance of the transmission line become Z.

20 Claims, 25 Drawing Sheets

(56) References Cited

U.S. PATENT DOCUMENTS

| | | | | |
|---|---|---|---|---|
| 6,448,931 | B1 | 9/2002 | Deguchi et al. | 343/700 |
| 6,542,123 | B1 * | 4/2003 | Chen | 343/700 MS |
| 6,831,687 | B1 * | 12/2004 | Suzuki | 348/251 |
| 7,626,551 | B2 * | 12/2009 | Chien et al. | 343/700 MS |
| 7,969,361 | B2 * | 6/2011 | Castaneda et al. | 343/700 MS |
| 8,390,523 | B2 * | 3/2013 | Wang et al. | 343/702 |
| 8,638,266 | B2 * | 1/2014 | Liu et al. | 343/767 |
| 8,884,824 | B2 * | 11/2014 | Andrenko | 343/700 MS |
| 8,907,860 | B2 * | 12/2014 | Lee et al. | 343/841 |
| 2004/0070537 | A1 | 4/2004 | Kadambi et al. | 343/700 |

FOREIGN PATENT DOCUMENTS

| | | |
|---|---|---|
| JP | 07240696 | 9/1995 |
| JP | 2000068736 | 3/2000 |
| WO | 2005020371 | 3/2005 |

OTHER PUBLICATIONS

Chinese Office Action mailed Jan. 13, 2015 issued in Chinese Appln. No. 201280039492.4 together with partial English translation.

Cibin C. et al., "A Flexible Wearable Antenna", Antennas and Propogation Society Symposium, 2004, IEEE, vol. 4, Jun. 20, 2004, pp. 3589-3592.

Yu W. et al., "Application of FDTD Method to Conformal Patch Antennas", IEEE Proceedings: Microwaves, Antennas and Propagation, vol. 148, No. 3, Jun. 1, 2001, pp. 218-220.

Kin-Lu Wong, "Compact and Broadband Microstrip Antennas" In: "Compact and Broadband Microstrip Antennas", Dec. 31, 2002, John Wiley & Sons, New York, cover sheet and pp. 1-3, 7-8 and 23-26.

European Search Report mailed Apr. 15, 2015 in European Appln. No. 12828496.5.

* cited by examiner (a)

(b) C−C'

(a) B－B'

(b) B－B'

(c) B－B'

PLANAR INVERTED F ANTENNA WITH IMPROVED FEEDING LINE CONNECTION

BACKGROUND OF THE INVENTION

1. Technical Field

The present invention pertains to a planar inverted F antenna, and relates to an antenna used, for example, in electronic communication equipment such as a mobile phone and the like.

2. Background Art

Recently, the planar inverted F antenna has been used as a high-performance antenna which can be built in small-sized electronic communication equipment such as a wrist watch, a portable terminal, a sensor and the like, and various proposals have been made as indicated in Patent Documents 1 and 2.

FIG. 25 shows a basic structure of the inverted F antenna.

The planar inverted F antenna is configured by a ground conductive plate 100 which has been grounded, a main conductive plate 300 which functions as an excitation conductive plate to be arranged almost in parallel with the ground conductive plate 100 with a length of (¼)λ or in the neighborhood thereof relative to a wavelength λ, a short circuit plate 200 for short-circuiting the main conductive plate 300 and the ground conductive plate 100, and a feeding pin 410 which has been connected to the main conductive plate at a position apart from the short circuit plate 200 by a prescribed distance s.

A feeding line to the main conductive plate 300 is configured such that a through-hole 110 is formed in the ground conductive plate 100 so as to supply power from below the ground conductive plate 100 side through the through-hole 110, thereby minimizing the influence on antenna characteristics.

Then, a central conductor of a coaxial line 400 is connected to the main conductive plate 300 as the feeding pin 410, while an external conductor 420 is connected around the through-hole 110 in the ground conductive plate 100.

In such a planar inverted F antenna, it is necessary to set the feeding impedance of the main conductive plate 300 to 50Ω from its relationship with a circuit to which the antenna is to be connected, and therefore a point which is at the prescribed distance s from the short circuit plate 200 is set as a feeding point and the feeding pin 410 is connected to this feeding point.

This prescribed distance s is determined in accordance with various conditions such as a distance between the ground conductive plate 100 and the main conductive plate 300, a dielectric constant ∈ between them and the like and is reduced as the planar inverted F antenna is miniaturized.

At a frequency which is generally used in the mobile phone or the like, this prescribed distance s is not more than 10 mm in many cases and is not more than 1 mm in some cases depending on the conditions.

Then, the prescribed distance s relative to the feeding point is a value which is strictly determined and even a slight shift (for example, a shift of 0.1 mm) will result in a shift in feeding impedance from 50Ω. A power loss is induced by this mismatching and it becomes impossible to obtain desired antenna characteristics.

Thus, in the conventional planar inverted F antenna, it was necessary to accurately attach the feeding pin 410 to the feeding point.

Then, since higher positional precision has been demanded in a narrow range of not more than 10 mm with respect to the attachment position of the feeding pin 410, the attachment procedure has been troublesome.

In addition, in the conventional planar inverted F antenna, while the connection spot of the feeding pin 410 is situated in the vicinity of the short circuit plate 200, the position of radiation by the antenna is situated on the open end side opposite to the short circuit plate 200.

Since the feeding position and the radiation position are situated on the opposite sides as mentioned above, if the feeding position of this antenna is arranged on the end side of the electronic equipment, connection of the feeding pin 410 will become easy, but the radiation position will get into the device. Therefore, it sometimes occurred that the antenna performance is deteriorated under the influence of an electric circuit or, in case of the mobile phone, under the influence of the hand of a person who grips it.

To the contrary, if the radiation position is arranged on the end side of the electronic equipment by prioritizing the antenna performance, the feeding position will be within the device, and therefore, such a problem occurred that the connection of the feeding pin 410 becomes not easy.

PRIOR ART DOCUMENTS

Patent Document

Patent Document 1: Japanese Patent Application Laid-Open No. 2009-77072

Patent Document 2: Japanese Patent Application Laid-Open No. 2002-64322

The present invention aims to provide a planar inverted F antenna to which a feeding line can be readily connected.

SUMMARY OF THE INVENTION (1) In one aspect, the invention provides a planar inverted F antenna, comprising a ground conductive plate which is folded at one or a plurality of point(s) along a prescribed direction and is to be connected to the ground, a main conductive plate folded at one or a plurality of point(s) in the same direction as said prescribed direction, and a short circuiting member for connecting said ground conductive plate and said main conductive plate at one or a plurality of point(s) on one side in said prescribed direction, said main conductive plate, comprising: one or a plurality of slit(s) formed from the other end on the side opposite to the side to which said short circuiting member is connected up to a position where an input impedance of the antenna becomes Z; a microstrip line which is formed between a side end of said main conductive plate and said one slit, or between adjacent slits in said plurality of slits with a width w that a characteristic impedance becomes Z and to which a feeding line is to be connected; and one or a plurality of excitation conductive plate(s) formed on a side of said slit to which said microstrip line is not adjacent.

(2) In a first embodiment of the planar inverted F antenna, the ground conductive plate is formed into a U-shape in section by being folded at two points, and the main conductive plate is formed into the U-shape in section by being folded at two points on the outer side of the ground conductive plate.

(3) In a second embodiment of the planar inverted F antenna, the ground conductive plate is formed into an L-shape in section by being folded at one point, and the main conductive plate is formed into the L-shape in section by being folded at one point on the outer side of the ground conductive plate.

(4) In a third embodiment of the planar inverted F antenna according to the first or second embodiment, the main conductive plate is folded at the slit part.

(5) In a fourth embodiment of the planar inverted F antenna according to any of the first, second and third embodiments, the ground conductive plate, the short circuiting member and the main conductive plate are integrally formed from one mutually contiguous conductive plate and are formed by being folded in the same direction at a connection part of the ground conducive plate with the short circuiting member and a connection part of the short circuiting member with the main conductive plate.

(6) In a fifth embodiment of the planar inverted F antenna according to any of the first, second, third and fourth embodiments, the main conductive plate is formed with the slits by two at positions on both sides equally spaced from a widthwise center of the main conductive plate, by which the microstrip line is formed on the center of the main conductive plate, and a first excitation conductive plate and a second excitation conductive plate are formed on both sides thereof, and are folded in the same direction at the both slit parts.

(7) In a sixth embodiment of the planar inverted F antenna according to said the fifth embodiment, the first excitation conductive plate and the second excitation conductive plate are formed to have different lengths.

(8) In a seventh embodiment of the planar inverted F antenna according to the fifth embodiment, the first excitation conductive plate and the second excitation conductive plate are formed to have different spaces in space with the ground conductive plate.

(9) In an eighth embodiment of the planar inverted F antenna according to any of the first to seventh embodiments, a through-hole for feeding line is formed in the ground conductive plate at a position corresponding to an open end of the microstrip line.

(10) In a ninth embodiment of the planar inverted F antenna according to the eight embodiment, the through-hole is formed into a slit-shape in a longitudinal direction of the microstrip line, and a plurality of through-holes or a slit-shape through-hole are/is formed in the microstrip lines at a position facing the through-hole.

(11) In a tenth embodiment of the planar inverted F antenna according to the ninth embodiment, the through-hole is formed into a slit-shape in a longitudinal direction of the microstrip line, and a plurality of grooves in a direction intersecting with the longitudinal direction are formed in the microstrip line at a position facing the through-hole.

According to the present invention, since such a configuration has been made that the power is supplied to a feeding point where the input impedance of the antenna becomes Z via the microstrip line of the width w that the characteristic impedance becomes Z, connection of the feeding line to the microstrip line can be readily performed.

DETAILED DESCRIPTION OF THE EMBODIMENTS

Figure 1:
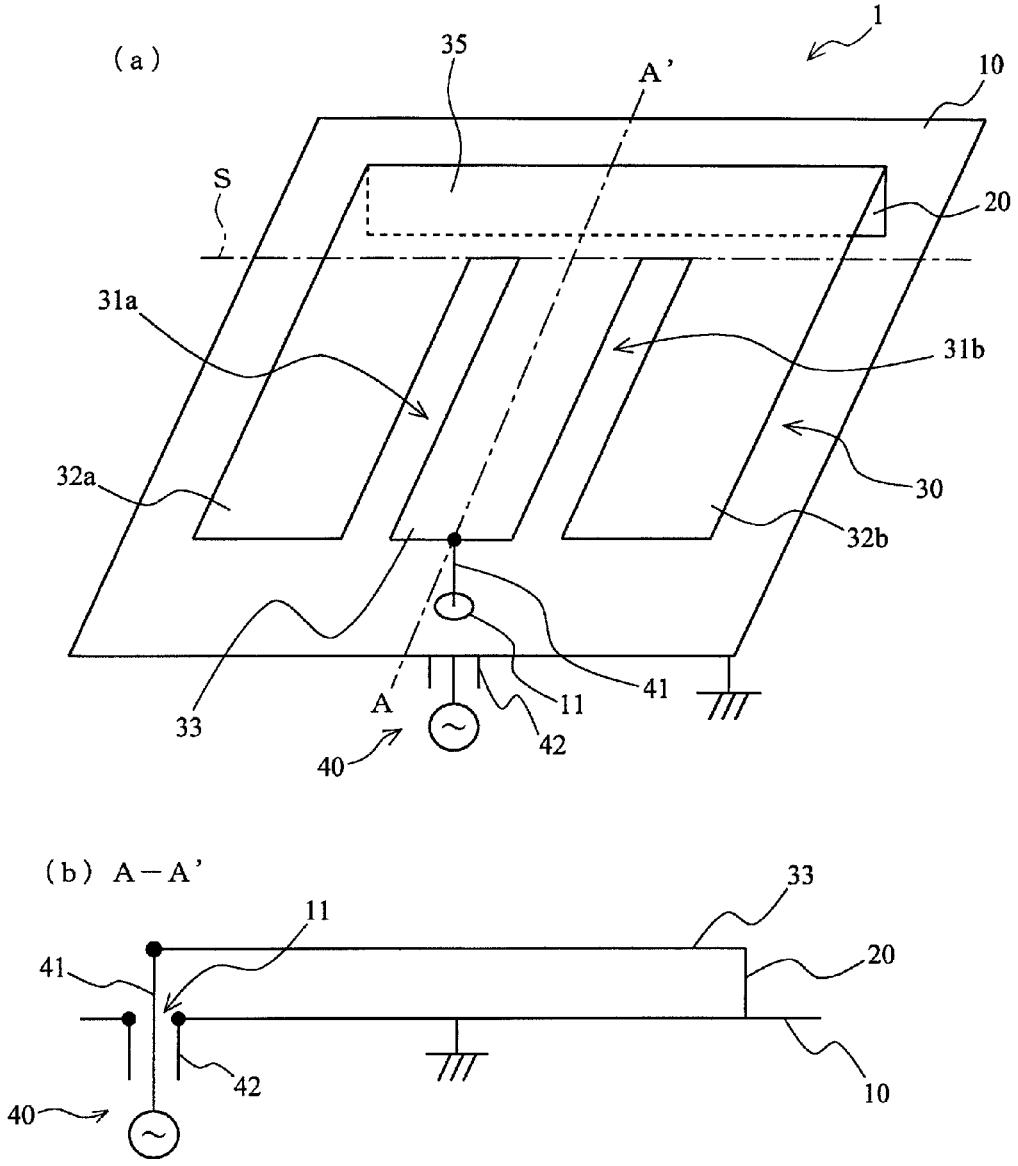
FIG. 1 shows a configuration of a planar inverted F antenna pertaining to a first embodiment.

In a planar inverted F antenna of the present embodiment, one or two slit(s) is/are disposed up to a point of the prescribed distance s where the input impedance Z (for example, Z=50Ω) is attained from the position of a short circuit point (a short circuit plate, a short circuit pin) of a main conductive plate 30, from a radiation end side (the side opposite to the short circuit point). That is, the slit is disposed from an open end side of the main conductive plate up to the spot where the input impedance becomes Z.

Since this slit can be formed by machining such as punching, cutting or the like, the slit can be accurately and readily formed up to a line S where the input impedance Z is attained.

Then, the conductive part between a side end of the main conductive plate and one slit or between two slits is used as a microstrip line (MSL) and the width w is determined such that the characteristic impedance of a transmission line becomes Z (for example, Z=50Ω).

The power can be supplied to the spot where the input impedance Z is attained via the MSL by providing the slit from the radiation end side of the main conductive plate and using part of the main conductive plate as the MSL as mentioned above. The main conductive plate other than the MSL functions as an excitation conductive plate. Therefore, since with regard to connection of a feeding line from the outside, it may be connected onto the MSL and precision in terms of connection position is not demanded, the attaching work can be facilitated.

With regard to connection of the feeding line from the outside, a connection line of the characteristic impedance Z, for example, a central conductor of a coaxial line is used and this is connected to the open end of the MSL as the feeding pin. Since the connection position of the feeding pin is not the feeding point where the position precision is demanded and there is no need to consider the position precision, it can be readily connected.

In addition, a connection end of the feeding pin and a radiation end can be provided on the same side.

With regard to the planar inverted F antenna so configured, the planar inverted F antenna which is U-shaped or L-shaped in section is formed by folding it on the both sides or one side of the MSL along a length direction of the MSL. That is, there is formed the planar inverted F antenna that the excitation conductive plate and the MSL are installed on the outer side of a ground conductive plate which has been folded to be U-shaped or L-shaped in section, separated from each other by a prescribed distance.

A positional relationship between the connection position and the radiation end of the feeding pin can be changed by folding the planar inverted F antenna along the length direction of the MSL.

In addition, in the planar inverted F antenna which has been folded on the both sides of the MSL, radiation from the excitation conductive plates which are arranged on both surface sides of the electronic equipment becomes possible by arranging a circuit board of the electronic equipment such as the mobile phone or the like so as to nip it with the folded ground conductive plate.

Details of Embodiments

FIG. 1 shows a configuration of a planar inverted F antenna 1 pertaining to a first embodiment.

FIG. 1(*a*) shows a perspective state of the planar inverted F antenna 1 and FIG. 1(*b*) shows a A-A' section, both being shown by diagrams for simplification.

As shown in FIG. 1, the planar inverted F antenna 1 is provided with a ground conductive plate 10, a short circuit plate 20 which functions as a short circuiting member, a main conductive plate 30 and a coaxial line 40.

Although all of the ground conductive plate 10, the short circuit plate 20 and the main conductive plate 30 are formed by conductive members using a metal such as brass or the like, it is also possible to use a conductive resin and formation on a dielectric substrate is also possible.

The ground conductive plate 10 is formed larger than the main conductive plate 30 and at least the radiation end side (the side opposite to the short circuit plate 20) of the ground conductive plate 10 is formed longer than the main conductive plate 30.

The short circuit plate 20 is connected to the ground conductive plate 10 at one end and is connected to the main conductive plate 30 at the other end. The short circuit plate 20 physically supports the main conductive plate 30 and grounds the main conductive plate 30 by making the ground conductive plate 10 to short-circuit it.

Incidentally, although in FIG. 1, the short circuit plate 20 is connected across the entire width of the main conductive plate 30 by making it to have a length which is the same as a width b (described later) of the main conductive plate 30, it is sufficient for it to have a function of grounding the main conductive plate 30 by connecting it to the ground conductive plate 10, and therefore a short circuit plate which is narrower in width may be connected and a short circuit pin may be connected (the same also applies to other embodiments and modified examples which will be described hereinafter).

The main conductive plate 30 is formed almost in parallel with the ground conductive plate 10 with the width corresponding to the height of the short circuit plate 20 by connecting the short circuit plate 20 to its end. However, the main conductive plate 30 needs only be supported by the short circuit plate 20 within a range that it is not in electrical contact with the ground conductive plate 10, it is not always necessary to be in a completely parallel state, and, for example, they may be in a slightly displaced parallel state. In the following, it will be expressed as "parallel" in the same meaning.

Here, a distance h between the ground conductive plate 10 and the main conductive plate 30 is determined by considering physical limitations permitted for the planar inverted F antenna 1, a bandwidth (for example, the more the distance h is increased, the more the bandwidth which can be used is increased) that the planar inverted F antenna 1 requires, a trade-off with a gain and the like.

The main conductive plate 30 is configured by slits 31*a* and 31*b*, a first excitation conductive plate 32*a*, a second excitation conductive plate 32*b*, and an MSL 33 and a base 35.

In addition, to one end side of the main conductive plate 30, the short circuit plate 20 is connected. Then, the two slits 31*a* and 31*b* are formed from an open side end (an end on the opposite side of the short circuit plate 20) of the main conductive plate 30 up to the line S where the input impedance becomes Z. The slits 31*a* and 31*b* are formed at positions equally apart from a width-wise center (the position of an A-A' line) of the main conductive plate 30 in left and right directions. Then, from an inner end of the main conductive plate 30 of the slits 31*a* and 31*b* up to one end side thereof to which the short circuit plate 20 is connected will be defined as the base 35.

By these two slits 31*a* and 31*b*, the first excitation conductive plate 32*a* is formed on the outer side of the slit 31*a*, the microstrip line (MSL) 33 is formed between the both slits 31*a* and 31*b*, and the second excitation conductive plate 32*b* is formed on the outer side of the slit 31*b*.

Here, the width of the MSL 33 will be described.

In a case where the width of the MSL 33 is w, its thickness is t, a dielectric constant of a dielectric substrate between it and the ground conductive plate 10 is ∈r and its distance (a thickness of the dielectric substrate) with the ground conductive plate 10 is h, the characteristic impedance Z (Ω) of the MSL 33 is calculated from the following formula (1).

$$Z=\{87/\sqrt{(\in r+1\cdot 41)}\}\times \ln\,[5.98h/(0.8w+t)] \quad (1)$$

Incidentally, in the above formula (1), in denotes a natural logarithm.

The line S that the input impedance Z is attained is a virtual line passing through the point (the feeding point) which is at the prescribed distance s where the input impedance Z (Z=50Ω in this embodiment) is attained from the connection position of the short circuit plate 20 on the main conductive plate 30 and it is not always a straight line. That is, the line S is a set of points where the input impedance of the antenna becomes Z. Although the points are not always distributed on the straight line, the line S will be indicated by the straight line for the convenience of description in the present embodiment.

The width of the base 35 is determined by simulation, trail manufacture or the like every time the planar inverted F antenna 1 is designed.

The first excitation conductive plate 32*a* and the second excitation conductive plates 32*b* are configured by including not only the regions where the slits 31*a* and 31*b* are formed but also the base 35.

That is, from the end of the main conductive plate 30 to which the short circuit plate 20 is connected down to the open end on its opposite side serves as the first excitation conductive plate 32*a* and the second excitation conductive plate 32*b* and is designed such that this length becomes ¼λ or a value in the neighborhood thereof relative to the desired wavelength λ.

Open ends of the first excitation conductive plate 32*a* and the second excitation conductive plate 32*b* function as radiation ends.

The MSL 33 is limited only between the slit 31*a* and the slit 31*b* and does not include the base 35. The MSL 33 is formed to have the width w that the characteristic impedance of the transmission line becomes Z (Z=50Ω).

It is preferable that a width g of the slits 31*a* and 31*b* should be a width sufficient not to be affected by an edge effect (a fringing effect, an influence by growth of an electric field between a conductor plate and a ground plate).

That is, since the mutual influence of the MSL 33 and the first excitation conductive plate 32*a*, the second excitation conductive plate 32*b* is eliminated when the width g of the slits 31*a* and 31*b* satisfies the conditions of the following simplified formula (2) relative to the distance h between the ground conductive plate 10 and the main conductive plate 30, it is preferable to satisfy the conditions of the numerical formula (2).

$$g>2\times(2h/\pi)\ln 2=0.88h \quad (2)$$

However, although the conditions by the formula (2) are more preferable conditions, in a case where there exists a restriction from design conditions depending on a product or the like that the planar inverted F antenna 1 is to be arranged, it would be sufficient if it is within a range that the influence is actually little.

Further, as the simplified width of the slits 31*a* and 31*b*, it can be, for example, at least about 10% of the width of the MSL 33.

A through-hole 11 is formed in the ground conductive plate 10 at a position facing the open end of the MSL 33.

The central conductor of the coaxial line 40 which functions as a feeding pin 41 passes through the through-hole 11 and is connected with the open end of the MSL 33 by welding or the like.

On the other hand, an external conductor 42 of the coaxial line 40 is connected with the ground conductive plate 10 by welding or the like on a peripheral edge of the through-hole 11.

Incidentally, in FIG. 1, a connection point of the feeding pin 41 with the MSL 33 and a connection point of the external conductor 42 with the ground conductive plate 10 are indicated by black circles (the same also applies to the other figures).

Figure 2:
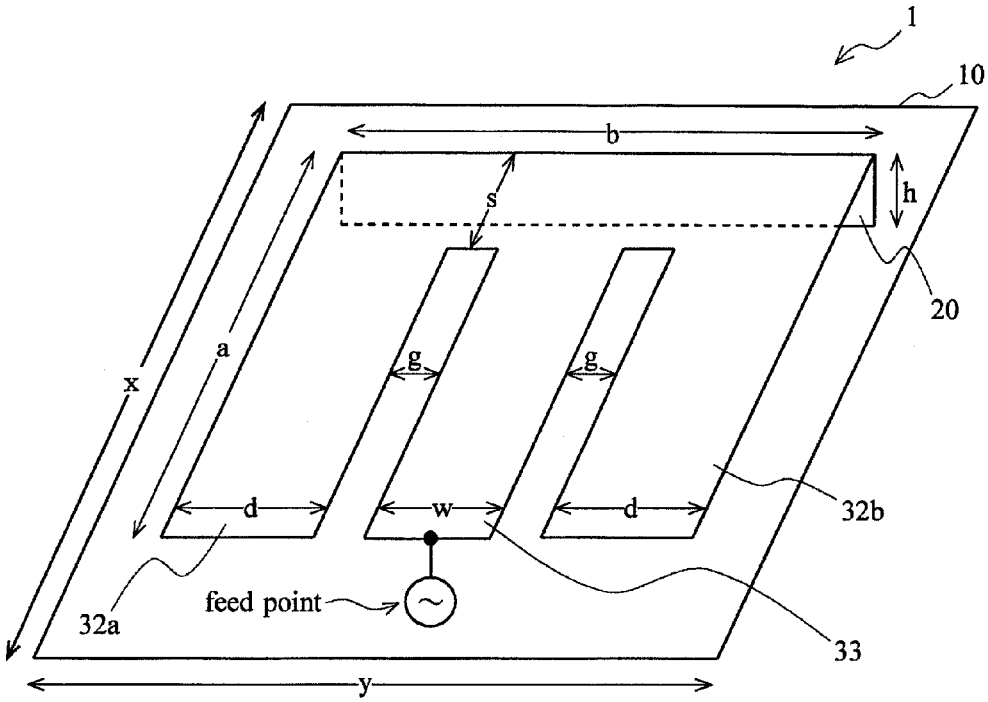
FIG. 2 shows structure parameters in the planar inverted F antenna.

FIG. 2 shows structure parameters of the planar inverted F antenna 1.

As shown in FIG. 2, the structure parameters of the respective parts of the planar inverted F antenna 1 will be defined as follows.

a is a length of the main conductive plate 30 (the first excitation conductive plate 32*a*, the second excitation conductive plate 32*b*) and a=(¼)λ or a value in the neighborhood thereof relative to the target wavelength λ.

b is the width of the main conductive plate 30.

d is a width of the first excitation conductive plate 32*a* and the second excitation conductive plate 32*b*.

g is the width of the slits 31*a* and 31*b* (a length of the slit will be (a−s)).

h is the distance between the ground conductive plate 10 and the main conductive plate 30 (=the height of the short circuit plate 20).

s is the distance from the connection position of the short circuit plate 20 on the main conductive plate 30 to the line S that the input impedance becomes Z.

w is the width of the MSL 33 and the width that the characteristic impedance becomes Z is selected as mentioned above. This width w is obtained by appropriately selecting the respective parameters in the above-mentioned formula (1) for obtaining the characteristic impedance.

x is a length of the ground conductive plate 10.

y is a width of the ground conductive plate 10.

For example, in the case of a 1.9 GHz-band planar inverted F antenna 1, as examples of the respective structure parameters, they can be set to the following values.

a=39.5 mm
b=21.3 mm
d=6.0 mm
g=1.0 mm
h=1.5 mm
s=6.76 mm
w=7.3 mm
x=60 mm
y=42 mm

The above values of the respective structure parameters are merely examples and can be appropriately selected in accordance with a frequency at which reception or transmission is performed, a region where a folding planar inverted F antenna 1 can be arranged and the like.

The planar inverted F antenna 1 which has adopted the above-mentioned respective structure parameters can be used, for example, as an antenna of a PHS (Personal Handyphone System).

In addition, as a planar inverted F antenna 1 to be used in a device for a wireless LAN, Bluetooth or the like using radio waves of around 2.45 GHz, the same performance can be exhibited by setting to values that 0.78 is multiplied by each of the above-mentioned respective structure parameters, that is, in the neighborhood of a=30.8 mm, b=16.7 mm, h=1.2 mm, d=4.7 mm, g=0.8 mm, w=5.7 mm, s=5.3 mm.

In addition, in a case where the planar inverted F antenna 1 is to be installed on the communication device such as the mobile phone or the like, it can be installed such that the open end side of the MSL 33 is situated not within a substrate of the communication device but on an end side of the communication device. Thus, it becomes easy to connect feeding pins 41, 43 to the MSL 33 from the end side of the communication device. In addition, since also the open end sides of the first excitation conductive plate 32*a* and the second excitation conductive plate 32*b* are situated on the end side of the communication device similarly to the MSL 33, such a thing that the antenna performance is deteriorated by being influenced by the electronic circuit or influenced by the hand of the person who grips it in the case of the mobile phone can be avoided.

In a case where the slits 31*a*, 31*b* of the planar inverted F antenna 1 have been taken in a longitudinal direction (the connection points of the feeding pins 41, 43 are on the upper side or lower side) of the communication device, vertical polarization would result. In a case where they have been taken in a lateral direction, horizontal polarization would result. Therefore, in a case where the planar inverted F antenna 1 is to be used in the mobile phone or the PHS that main reception is performed by vertical polarization, the slits 31*a* and 31*b* are installed so as to orient in the longitudinal direction.

The above respective values are merely examples, and although in the planar inverted F antenna 1 of the present embodiment, air is supposed as the dielectric substrate between the ground conductive plate 10 and the main conductive plate 30, another dielectric substrate may be arranged.

In this case, although also the values of the structure parameters are changed depending on the dielectric constant of the arranged dielectric substrate, in any case, the width w of the MSL 33 is selected such that the input impedance of the position (the feeding point) which is at the distance s becomes Z and also the characteristic impedance of the transmission line becomes Z.

As described above, the two slits 31*a* and 31*b* are provided in the main conductive plate 30 from its open end side so as to use part of the main conductive plate 30 as the microstrip line (MSL) 33.

Then, since the width w of the MSL 33 is selected such that the characteristic impedance becomes Z, for example, the central conductor of the coaxial line can be connected to the open end of the MSL 33 as the feeding pin and the precision is not demanded with regard to the connection position thereof. Therefore, the planar inverted F antenna 1 can be readily manufactured.

Figure 3:
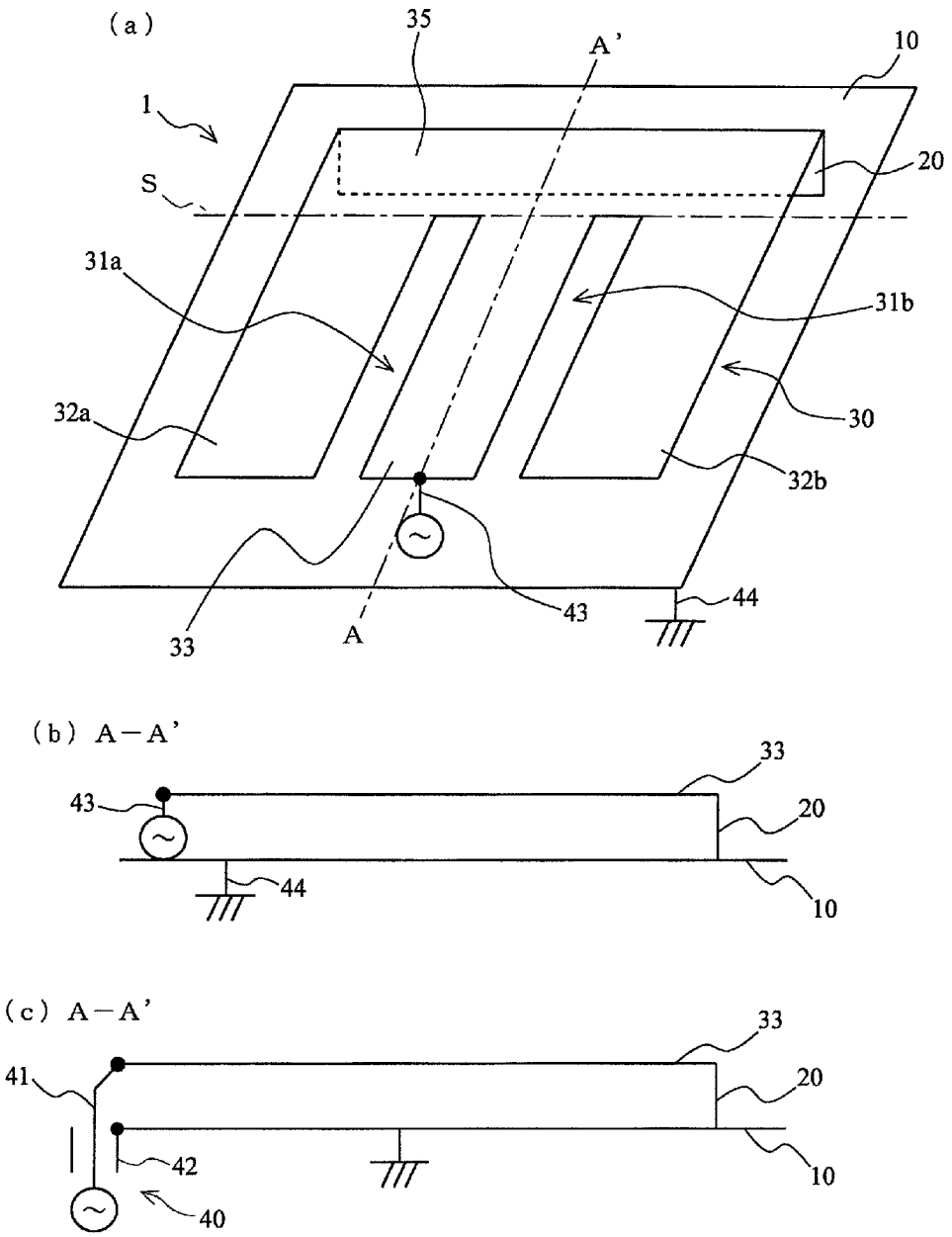
FIG. 3 shows a perspective state and sections, concerning a structure regarding a second embodiment in a planer inverted F antenna by diagrams.

FIG. 3 shows a perspective state (a), and A-A' sections (b) and (c) by diagrams, concerning a structure of a planar inverted F antenna 1 pertaining to a second embodiment.

Although description has been made with regard to a case that the feeding line is laid from below the ground conductive plate 10 by providing the through-hole 11 provided in the ground conductive plate 10 in the planar inverted F antenna 1 described in FIG. 1, in the second embodiment shown in FIG. 3, the feeding line is laid not from below the ground conductive plate 10 but from a side face side (the outer side) of the open end of the MSL 33.

By configuring to connect the feeding pin 43 to the open end of the MSL 33 from the side face side as mentioned above, the through-hole 11 in the ground conductive plate 10 becomes unnecessary.

On the other hand, while in the planar inverted F antenna 1 shown in FIG. 1, the ground conductive plate 10 is connected to the ground by connecting the external conductor 42 of the coaxial line 40 to the peripheral edge of the through-hole 11, in the second embodiment shown in FIG. 3, it can be connected to the ground by connecting a conductor 44 to an arbitrary position of the ground conductive plate 10.

Incidentally, in an example shown in FIG. 3(*c*), there is the A-A' sectional diagram of the planar inverted F antenna 1 that the open end side of the MSL 33 has been formed longer than the first excitation conductive plate 32*a* and the second excitation conductive plate 32*b* such that it is situated at almost the same position as the end of the ground conductive plate 10.

If the dielectric constant and the distance h between it and the ground conductive plate 10 and its width w are the same, the microstrip line exhibits the same characteristic impedance without being influenced by the length. Thus, by extending the MSL 33 up to the end of the ground conductive plate 10, it can be connected from below the ground conductive plate 10 and from its side face side by using the feeding pin 41 of the coaxial line 40 with no provision of the through-hole 11 in the ground conductive plate 10. In addition, it is also possible to connect the external conductor 42 of the coaxial line 40 to an end face of the ground conductive plate 10.

As described above, as a method of connecting the feeding pin to the MSL 33 of the planar inverted F antenna 1, any of a method by a through type that the feeding pin 41 is connected through the through-hole 11 provided in the ground conductive plate 10 as described in the first embodiment and a method by an external type that the feeding pin 43 is connected from the outside of the open end of the ground conductive plate 10 as described in the second embodiment can be adopted.

Also in respective embodiments described hereinbelow, although any of the through type and the external type can be selected excepting a case that it is mentioned that it is limited to any one of the feeding types, only any one of the feeding types will be shown for the convenience of illustration.

Figure 4:
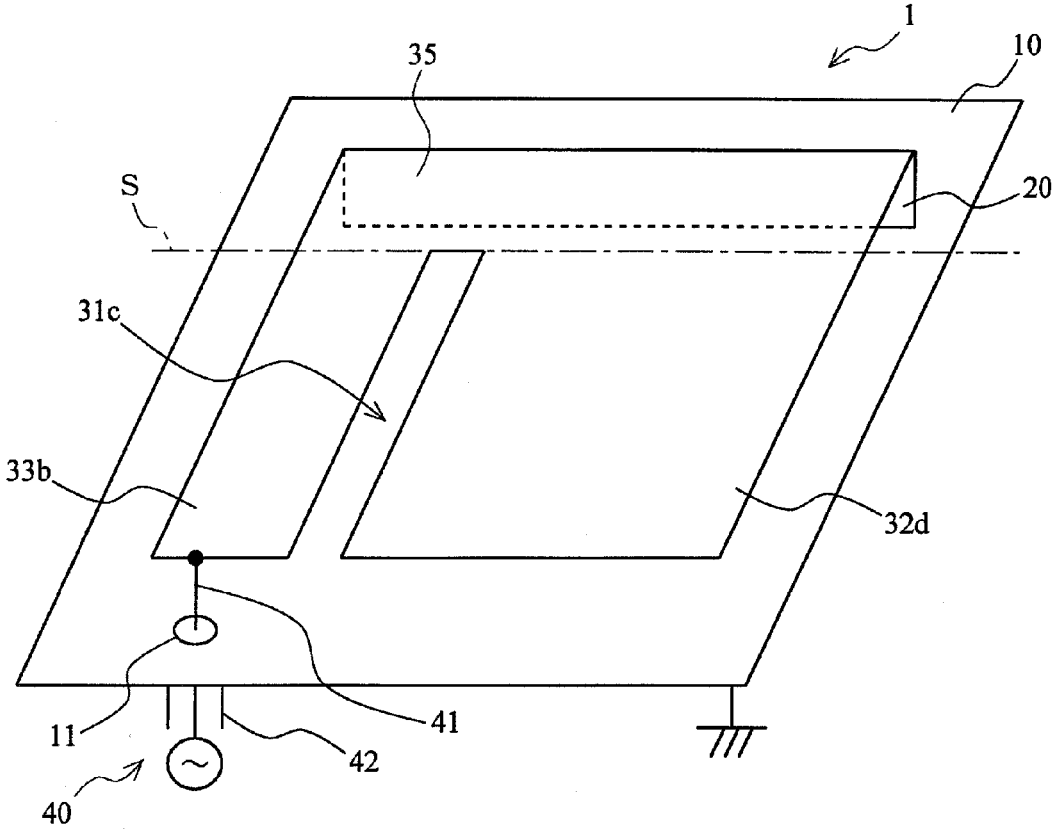
FIG. 4 shows a perspective state, concerning a structure of a planar inverted F antenna pertaining to another embodiment.

FIG. 4 shows a perspective state concerning a structure of a planar inverted F antenna 1 pertaining to another embodiment.

While, in the first embodiment shown in FIG. 1, the slits 31*a* and 31*b* are formed on the both sides thereof such that the MSL 33 is formed on the center of the main conductive plate 30, in this third embodiment, one slit 31*c* is formed at a position where the width w is attained from one side end of the main conductive plate 30.

The MSL 33 is formed on one side (the left side in the figure) of this slit 31*c* and an excitation conductive plate 32*d* is formed on the other side.

The length of the slit 31*c* is formed up to the line S where the input impedance becomes Z similarly to the first embodiment.

In addition, also with regard to the width w, a value that the characteristic impedance of the MSL 33 becomes Z is selected similarly to the embodiment.

Although in this embodiment, the width of the excitation conductive plate 32*d* is about two times that of the first excitation conductive plate 32*a* in the first embodiment, it is also possible to make it more or less than that.

According to this embodiment, since the number of slits can be reduced to one, the width of the planar inverted F antenna 1 can be narrowed and the planar inverted F antenna 1 can be miniaturized.

In addition, the planar inverted F antenna 1 can be more miniaturized by making the width of the excitation conductive plate 32*d* almost the same as the width of the first excitation conductive plate 32*a* in the first embodiment.

Figure 5:
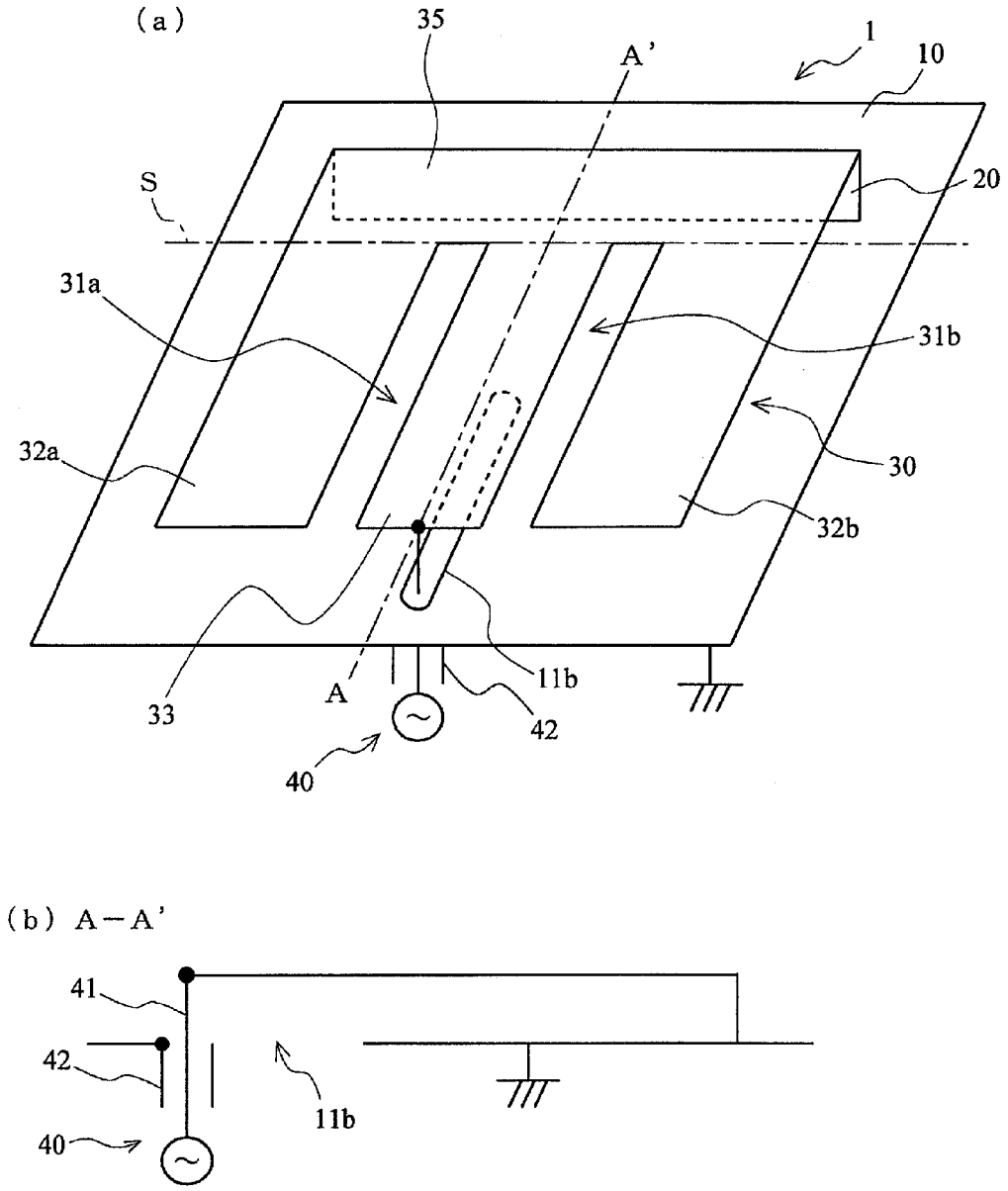
FIG. 5 shows a perspective state and a section, concerning a structure of a planar inverted F antenna pertaining to a further embodiment by diagrams.

FIG. 5 shows a perspective state (a), and an A-A' section (b), concerning a structure of a planar inverted F antenna 1 pertaining to a further embodiment by diagrams.

Incidentally, the feeding type of the planar inverted F antenna 1 shown in FIG. 5 is basically limited to the through type. However, that it is possible to perform external type feeding without using the through-hole is common to all of the planar inverted F antennas 1 formed into the through type.

In this embodiment, as shown in FIG. 5, a through-hole 11*b* to be installed in the ground conductive plate 10 is formed not into a circular shape but into a slit-like shape which is elongated in a length direction of the MSL 33.

By forming the through-hole 11*b* to be elongated as mentioned above, the position of the feeding pin 41 to be connected to the MSL 33 can be freely selected within a range of the length of the through-hole 11*b*, and the degree of freedom in feeding line arrangement can be raised.

Incidentally, a case that the feeding pin 41 has been connected to the endmost on the open end side is shown in FIGS. 5(*a*) and (*b*).

Then, in a case where the feeding pin 41 is to be connected to the side (the short circuit plate 20 side) which is more inward than that in the example in FIG. 5, through-holes through which the feeding pin 41 passes may be provided in a plurality of spots of the MSL 33 corresponding to the through-hole 11*b* and the feeding pin 41 may be made to pass through the through-hole concerned and may be welded from above.

In addition, it becomes possible to connect the feeding pin 41 to an arbitrary position by providing a slit of a width which makes it possible to pass the feeding pin 41 through it also in the MSL 33.

Further, not providing the through-hole and the slit in the MSL 33, a plurality of width-wise grooves may be formed in the MSL 33 so as to adjust the length by folding the MSL 33 along the grooves at the connection position of the feeding pin 41. The length of the MSL 33 can be varied as mentioned above because the length of the microstrip line is not defined as a parameter of the characteristic impedance.

Next, planar inverted F antennas 1 which have been made compatible with multifrequency will be described with reference to FIG. 6 to FIG. 10 by other embodiments.

Figure 6:
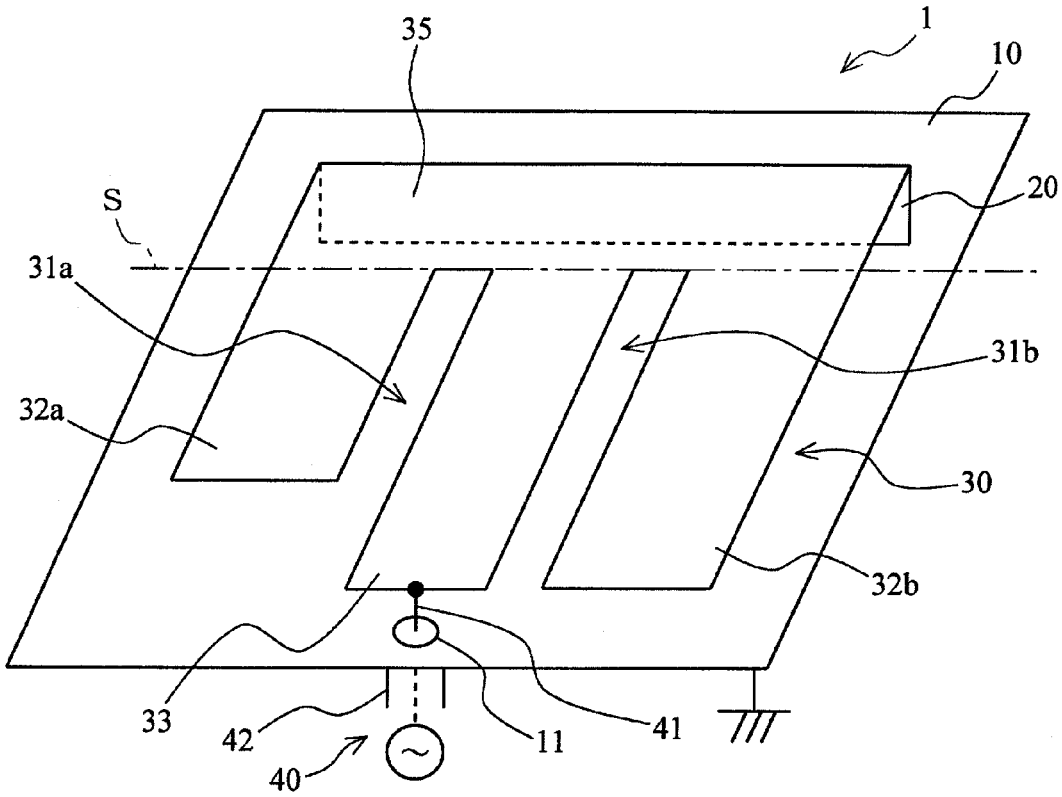
FIG. 6 shows a perspective state concerning a structure of a planar inverted antenna which has been made compatible with multifrequency.

FIG. 6 shows a perspective state concerning a structure of a planar inverted F antenna 1 which has been made compatible with multifrequency.

The planer inverted F antenna 1 of this embodiment has been made compatible with multifrequency by changing the lengths of the first excitation conductive plate 32*a* and the second excitation conductive plate 32*b* formed on the both sides of the MSL 33.

Although in the example in FIG. 6, it has been made compatible with multifrequency by making the length of the first excitation conductive plate 32*a* shorter than that of the second excitation conductive plate 32*b*, which one should be made longer is optional.

Figure 7:
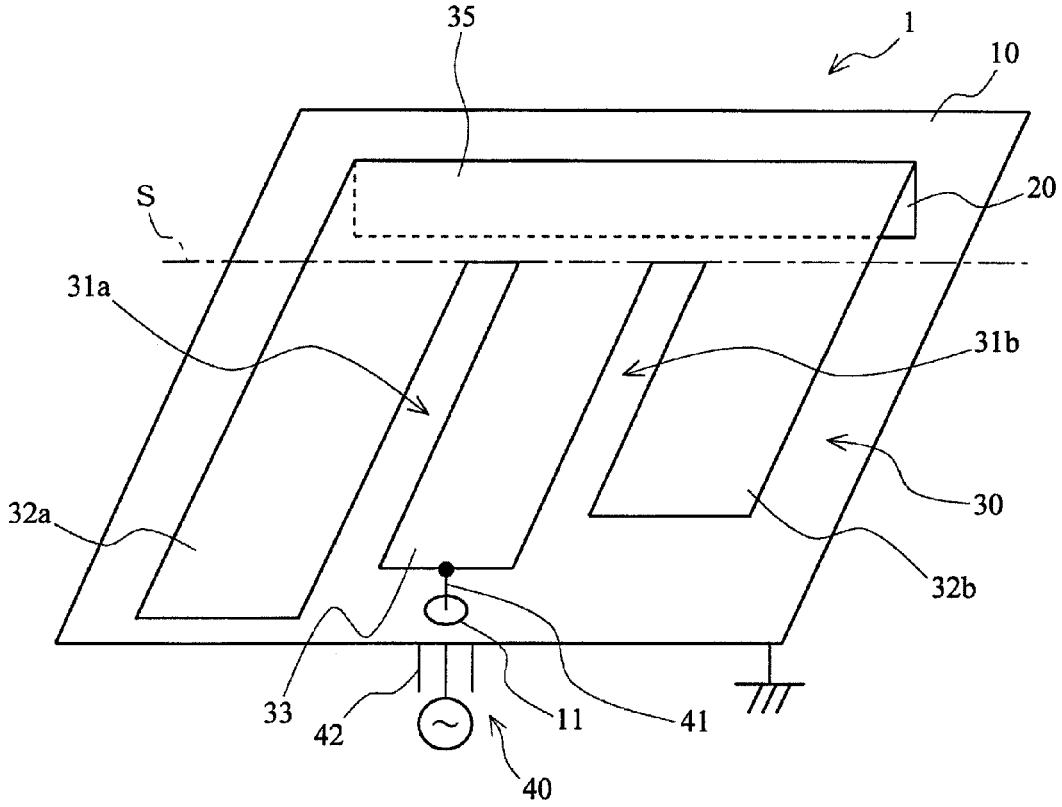
FIG. 7 shows a perspective state concerning a structure of a planar inverted F antenna which has been made compatible with multifrequency pertaining to another embodiment.

FIG. 7 shows a perspective state concerning a structure of a planar inverted F antenna 1 which has been made compatible with multifrequency pertaining to another embodiment.

In this embodiment, the first excitation conductive plate 32*a* has been formed long and the second excitation conductive plate 32*b* has been formed short using the length of the MSL 33 as a reference. It is also possible to make a great difference between the lengths of the first excitation conductive plate 32*a* and the second excitation conductive plate 32*b* as mentioned above also including the example in FIG. 6.

However, with regard to the first excitation conductive plate 32*a* which has been formed longer than the MSL 33, it is necessary to hold it within a range which is not longer than the open side end face of the ground conductive plate 10.

Figure 8:
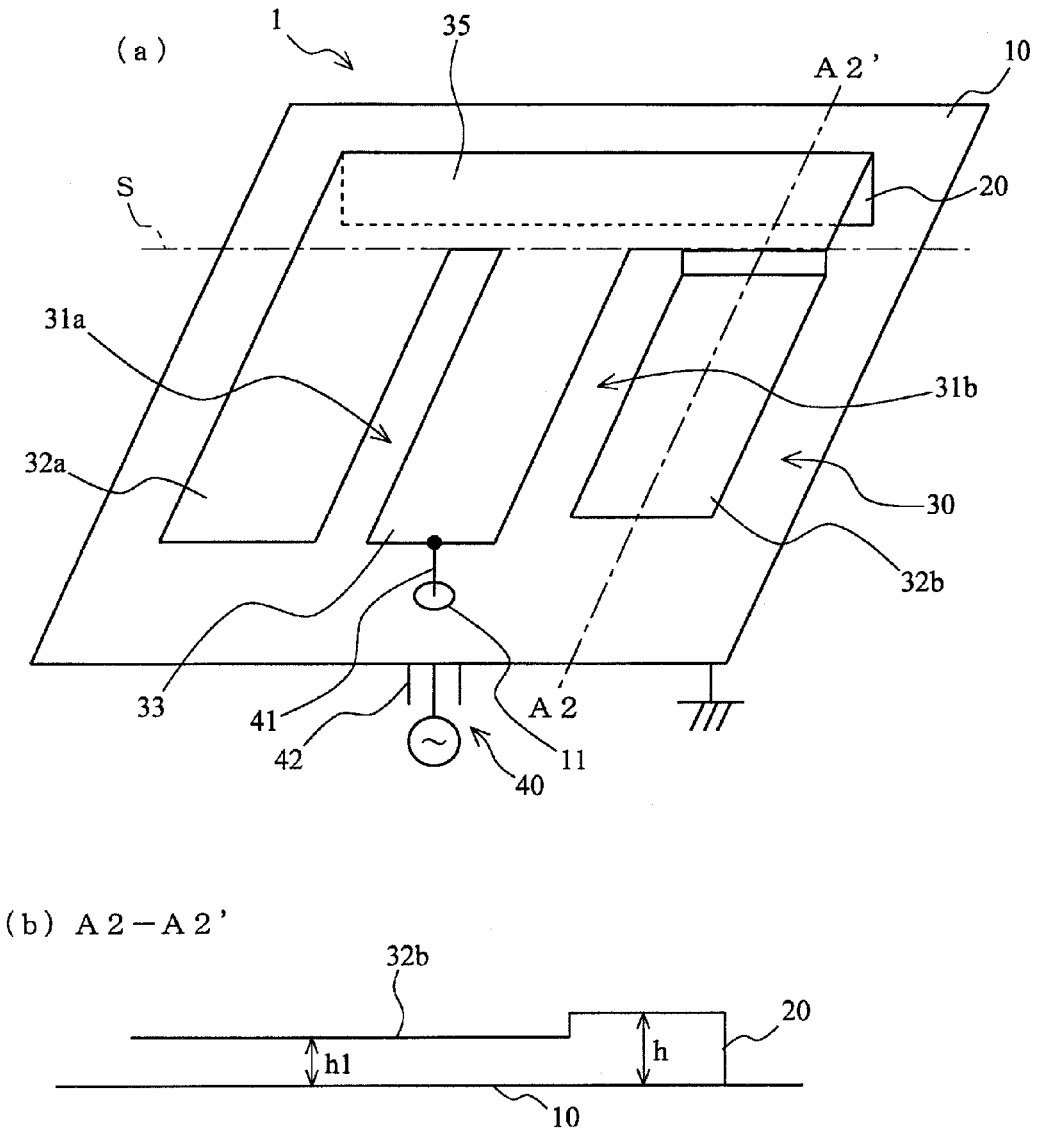
FIG. 8 shows a perspective state and a section, concerning a structure of a planar inverted F antenna which has been made compatible with multifrequency pertaining to a further embodiment by diagrams.

FIG. 8 shows a perspective state (a), and an A2-A2' section (b), concerning a structure of a planar inverted F antenna 1 which has been made compatible with multifrequency pertaining to a further embodiment by diagrams.

While, in the embodiments shown in FIGS. 6 and 7, multifrequency performance has been enabled by changing the lengths of the first excitation conductive plate 32*a* and the second excitation conductive plate 32*b*, in this embodiment shown in FIG. 8, multifrequency performance is enabled by making the lengths of the first excitation conductive plate 32*a* and the second excitation conductive plate 32*b* the same as each other and changing the distances from the ground conductive plate 10.

In a case where the height from the ground conductive plate 10 is designated by h as shown in FIG. 8(*b*), the not shown first excitation conductive plate 32*a* maintains the same height h along the full length.

On the other hand, the second excitation conductive plate 32*b* is formed to be h1 (h1<h) in height of a part from a folded spot to the open end by folding downward (toward the ground conductive plate 10 side) two times at any spot corresponding to the slit 31*b*.

Incidentally, the second excitation conductive plate 32*b* may be folded not downward but upward. In addition, one of the first excitation conductive plate 32*a* and the second excitation conductive plate 32*b* may be folded downward and the other may be folded upward.

Figure 9:
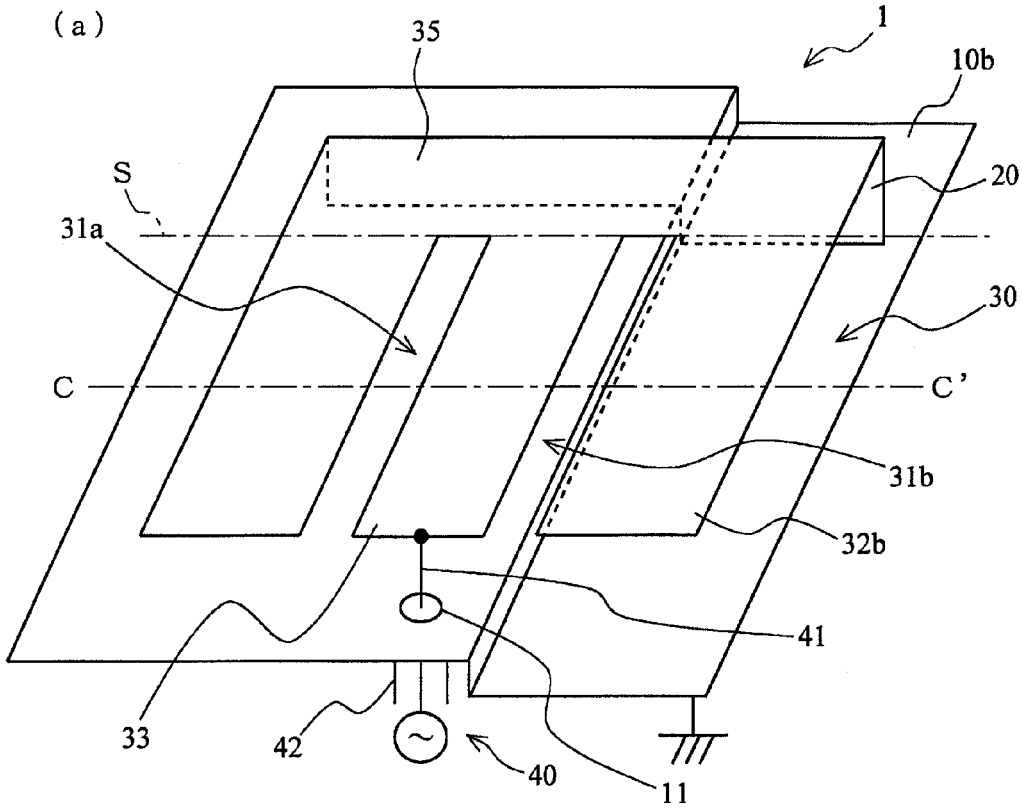
FIG. 9 shows a perspective state and a section, concerning a structure of a planar inverted F antenna which has been made compatible with multifrequency pertaining to a further embodiment by diagrams.
Figure 9:
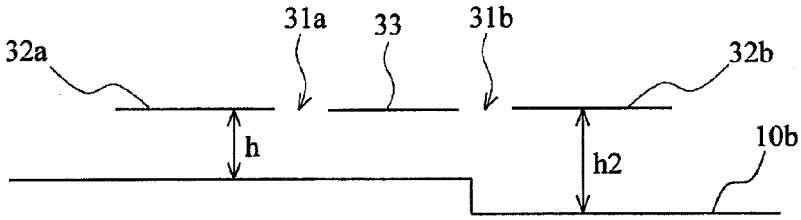

FIG. 9 shows a perspective state (a), and a C-C' section (b), concerning a structure of a planar inverted F antenna 1 which has been made compatible with multifrequency pertaining to a further embodiment by diagrams.

While in the embodiment shown in FIG. 8, multifrequency performance has been enabled by folding one or both of the first excitation conductive plate 32*a* and the second excitation conductive plate 32*b* downward, or upward so as to change the distances between them and the ground conductive plate 10*b*, in this embodiment, although it is same as the first embodiment with regard to the first excitation conductive plate 32*a* and the second excitation conductive plate 32*b*, multifrequency performance has been enabled by folding a ground conductive plate 10*b* downward two times along a longitudinal virtual line of the MSL 33.

In a case where the height between it and the first excitation conductive plate 32*a* has been set to h by folding the ground conductive plate 10*b* downward at the position corresponding to the slit 31*b* as shown in FIG. 9(*b*), it is formed to have a height h2 (h<h2) between it and the second excitation conductive plate 32*b*.

Although any place would be fine as a folding position of the ground conductive plate 10*b* if it is under the slit, an almost central position in a width direction of the slit 31 is preferable.

Though not shown, a difference between the distance between it and the first excitation conductive plate 32*a* and the distance between it and the second excitation conductive plate 32*b* may be made large by folding the ground conductive plate 10 upward at a position facing the slit 31*a* and further folding it downward at a position facing the slit 31*b*.

In the planar inverted F antennas 1 pertaining to the embodiments described in FIGS. 8 and 9 mentioned above, multifrequency performance has been attained by making a difference between the distance of the first excitation conductive plate 32*a* and the distance of the second excitation conductive plate 32*b* relative to the ground conductive plate 10.

On the other hand, it is also possible to enable multifrequency performance by making the distances between it and the first excitation conductive plate 32*a* and the second conductive plate 32*b* the same as each other and by changing the dielectric constant between the first excitation conductive plate 32*a* and the ground conductive plate 10 and the dielectric constant between the second excitation conductive plate 32*b* and the ground conductive plate 10.

That is, a dielectric substrate other than air, for example, a glass substrate ($\in r \neq 4.7$) or the like is arranged on any one of the first excitation conductive plate 32*a* and the second excitation conductive plate 32*b*.

Figure 10:
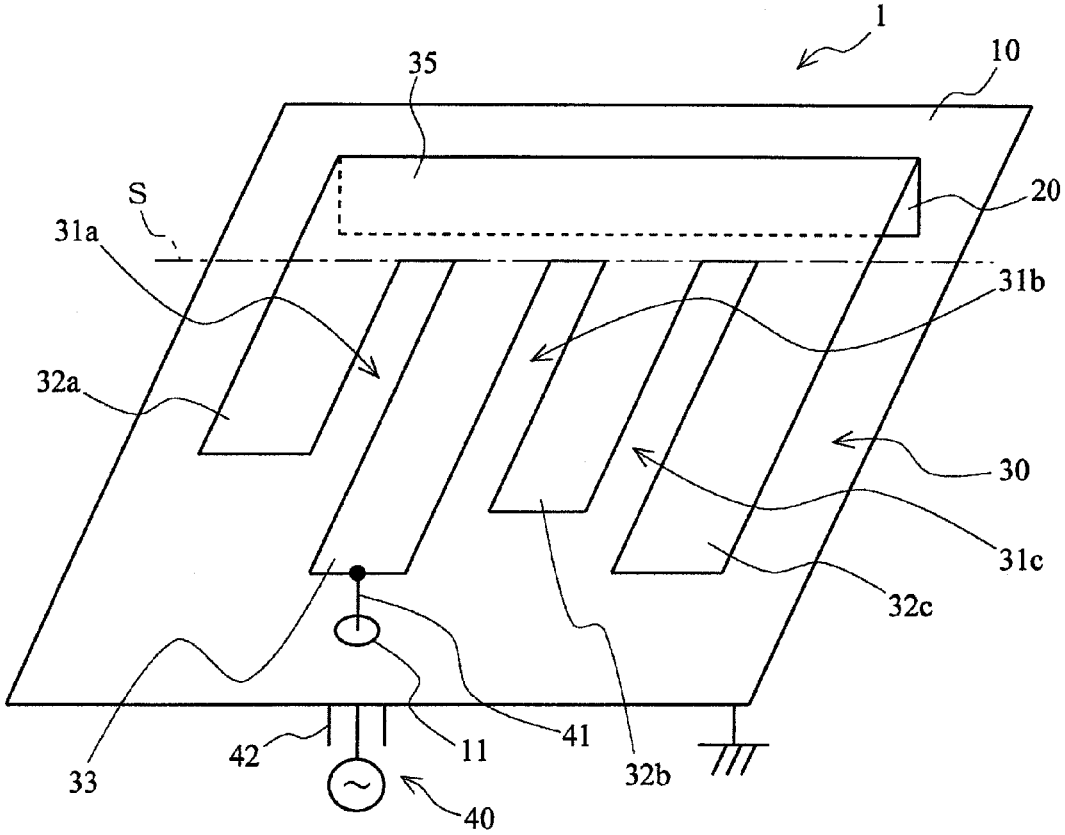
FIG. 10 shows a perspective state, concerning a structure of a planar inverted F antenna which has been made compatible with multifrequency pertaining to a further embodiment.

FIG. 10 shows a perspective state, concerning a structure of a planar inverted F antenna 1 which has been made compatible with multifrequency pertaining to a further embodiment.

The multifrequency compatible planar inverted F antennas 1 in FIG. 6 to FIG. 9 have been made compatible with two frequencies by setting the lengths or heights h of the first excitation conductive plate 32*a* and the second excitation conductive plate 32*b* to different values.

On the other hand, a third excitation conductive plate 32*c* is provided on the outer side of the second excitation conductive plate 32*b* via a slit 31*c* as shown in FIG. 10 and the respective lengths of the first excitation conductive plate 32*a*, the second excitation conductive plate 32*b* and the third excitation conductive plate 32*c* are set to different values so as to be made compatible with three frequencies. Incidentally, in order to enable further multifrequency performance, the first excitation conductive plate 32*a* to *n*-th excitation conductive plate 32 ($n \geq 4$) may be provided.

In this embodiment and the modified example thereof, the slits 31*a* and 31*b* to be formed on the both sides of the MSL 33 are formed similarly to the first embodiment.

On the other hand, although the slit 31*c* to be formed between the excitation conductive plate 32*b* and the excitation conductive plate 32*c* may be formed from the open end up to the line S that the input impedance becomes Z, since the slit 31*c* is not the slit for forming the MSL 33, this is not necessarily the case. Incidentally, in a case where the slit 31*c* has been formed shorter or longer than the one up to the line S, the base 35 corresponding to the excitation conductive plate 32*c* ranges from an inner end of the slit 31*c* up to the short circuit plate 20.

The width of the slit 31*c* is determined from the viewpoint of mutual interference prevention among the excitation conductive plates 32.

Figure 11:
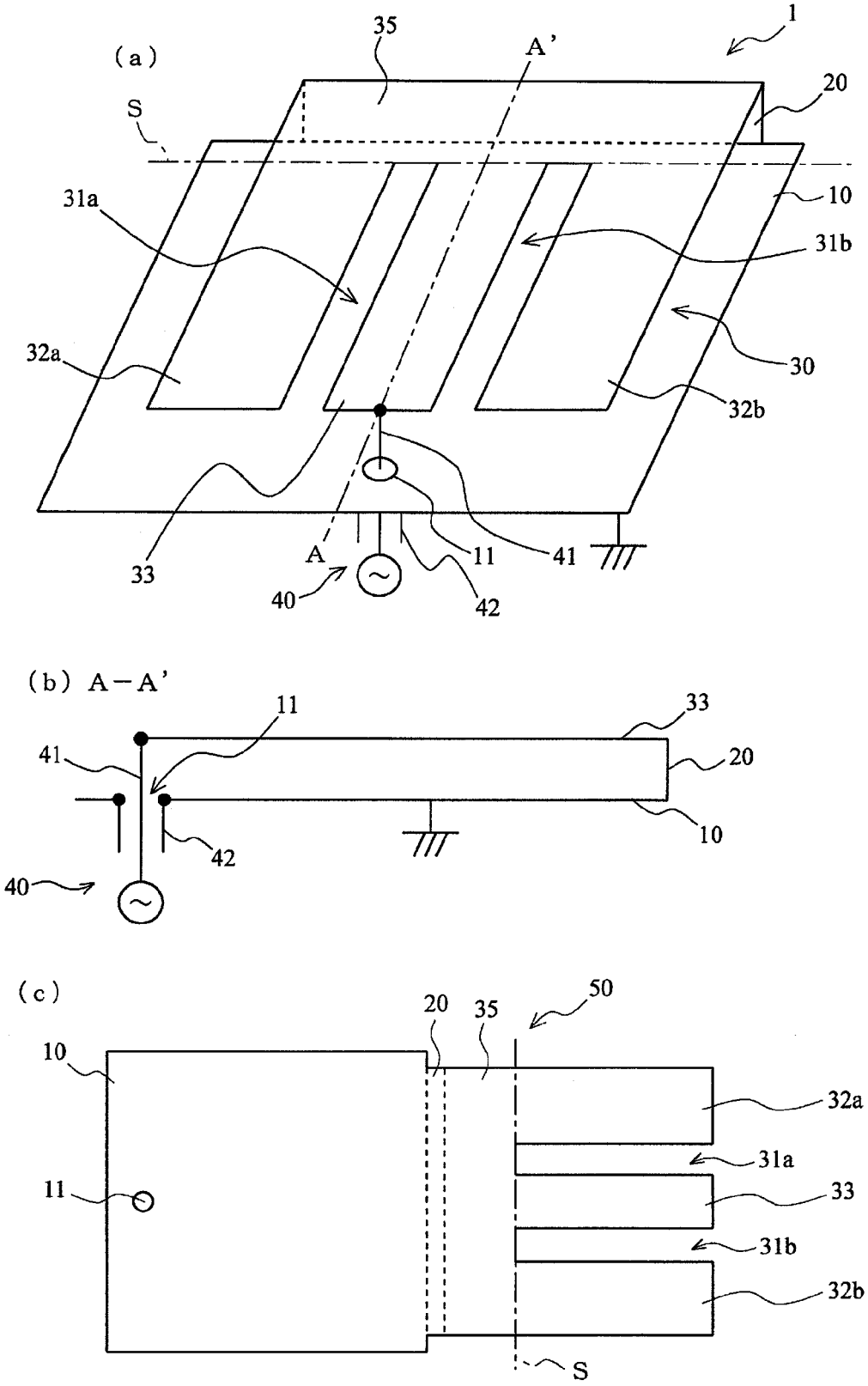
FIG. 11 shows a structure of a planar inverted F antenna pertaining to another embodiment and production thereof.

FIG. 11 shows a structure of a planar inverted F antenna 1 pertaining to a further embodiment and production thereof.

In the planar inverted F antennas 1 described in FIG. 1 to FIG. 10, the short circuit plate 20 is connected to a prescribed distance u ($u<x-a$: see FIG. 2 for x, a) from the end face of the ground conductive plate 10. Connection in this case is made by welding or the like.

In contrast, in the planar inverted F antenna 1 shown in FIG. 11, the short circuit plate 20 is connected with the end of the ground conductive plate 10.

Although also in connection of the short circuit plate 20 with the ground conductive plate 10 in this case, both may be separately formed and may be connected together by welding, the ground conductive plate 10, the short circuit plate 20, and the main conductive plate 30 may be also formed integrally by punching or cutting a conductive member 50 using a metal such as brass or the like as shown in FIG. 11(*c*).

Then, as shown by dotted lines in FIG. 11(*c*), the planar inverted F antenna 1 is formed by folding (valley-folding) it by about 90 degrees each time at a connection spot of the ground conductive plate 10 with the short circuit plate 20 and a connection spot of the short circuit plate 20 with the main conductive plate 30 until the ground conductive plate 10 and the main conductive plate 30 come into parallel with each other. Then, the feeding pin 41 is welded to the open end of the MSL 33 through the through-hole 11 and the external conductor 42 is connected to the peripheral edge of the through-hole 11 in this planar inverted F antenna 1, by which the planar inverted F antenna 1 shown in FIG. 11(*a*) is formed.

Incidentally, although the planar inverted F antenna 1 of the through type as the feeding line has been described in FIG. 11, in a case where the external type planar inverted antenna 1 is to be formed, the through-hole 11 is unnecessary.

Also with regard to the planar inverted F antennas 1 of the respective embodiments described in FIG. 1 to FIG. 10, the ground conductive plate 10, the short circuit plate 20 and the main conductive plate 30 may be integrally formed by similarly punching and may be formed by folding as the planar inverted F antenna 1 modified to the type that the short circuit plate 20 is connected to the end of the ground conductive plate 10.

However, in the case of the planar inverted F antenna 1 which has been made compatible with multifrequency by folding the ground conductive plate 10 described in FIG. 9, punching or the like is performed such that the ground conductive plate 10 and the second excitation conductive plate 32*b* the distance (height) between which is long are integrated.

In this case, although the short circuit plate 20 may be provided only on the second excitation conductive plate 32*b* part, it is also possible to provide it also on the MSL 33 and first excitation conductive plate 32*a* parts. In this case, the short circuit plate 20 corresponding to the height of the part concerned is integrally formed to be contiguous to any one side of the ground conductive plate 10 side and the base 35 side, is folded and thereafter is welded with the other side.

In the planar inverted F antennas 1 described in FIG. 1 to FIG. 11, a case that the first excitation conductive plate 32*a*, the second excitation conductive plate 32*b* and the MSL 33 are arranged on the same plane or on parallel planes has been described.

Figure 12:
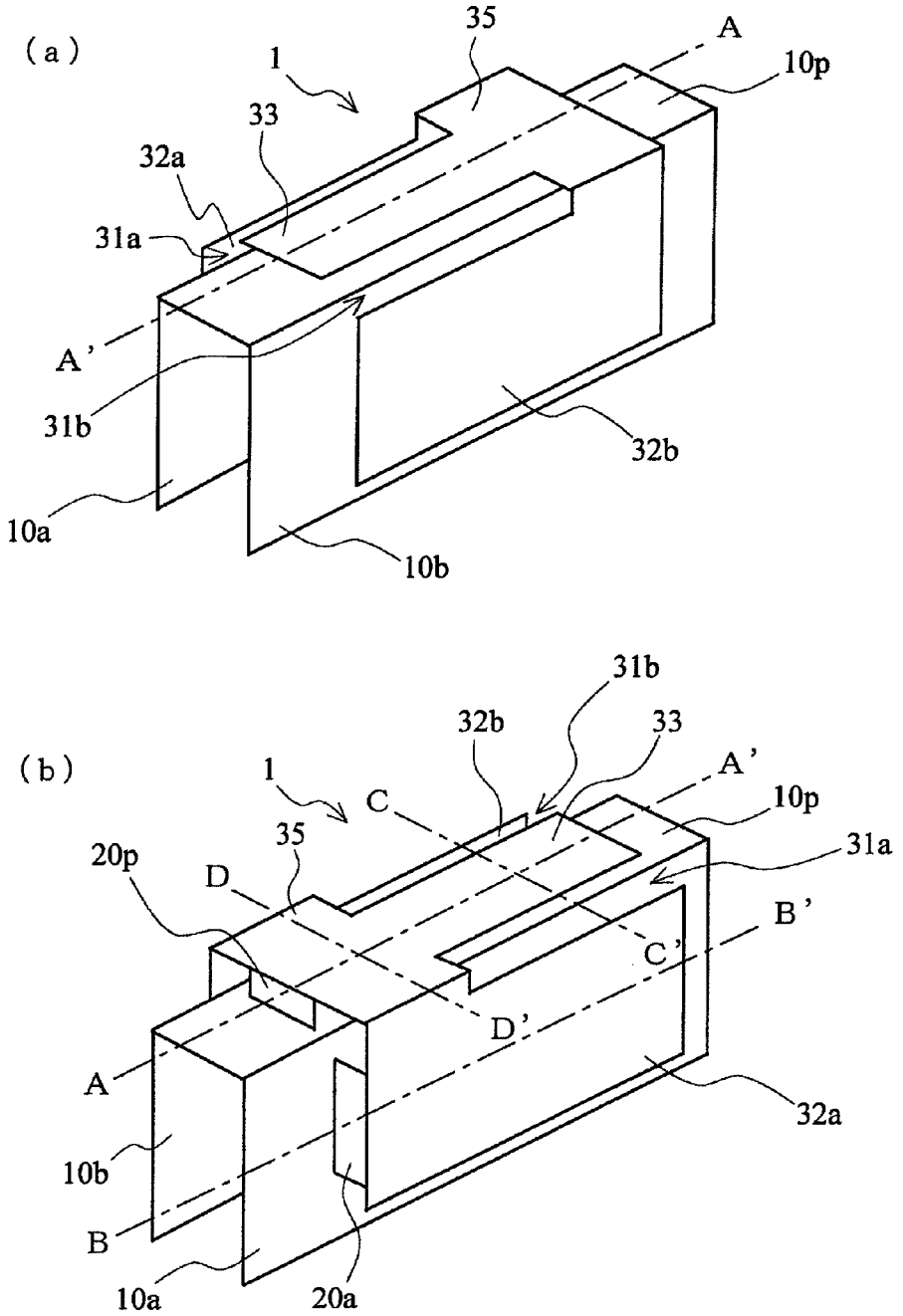
FIG. 12 shows perspective states from its different directions, concerning a basic structure of a folding type planar inverted F antenna.

On the other hand, in planar inverted F antennas 1 described in FIG. 12 and succeeding figures, it is formed to be U-shaped in section or L-shaped in section by folding one or two spots along the length direction of the MSL 33.

FIG. 12 shows perspective states from its different directions, concerning a basic structure of a folding type planar inverted F antenna 1.

Figure 13:
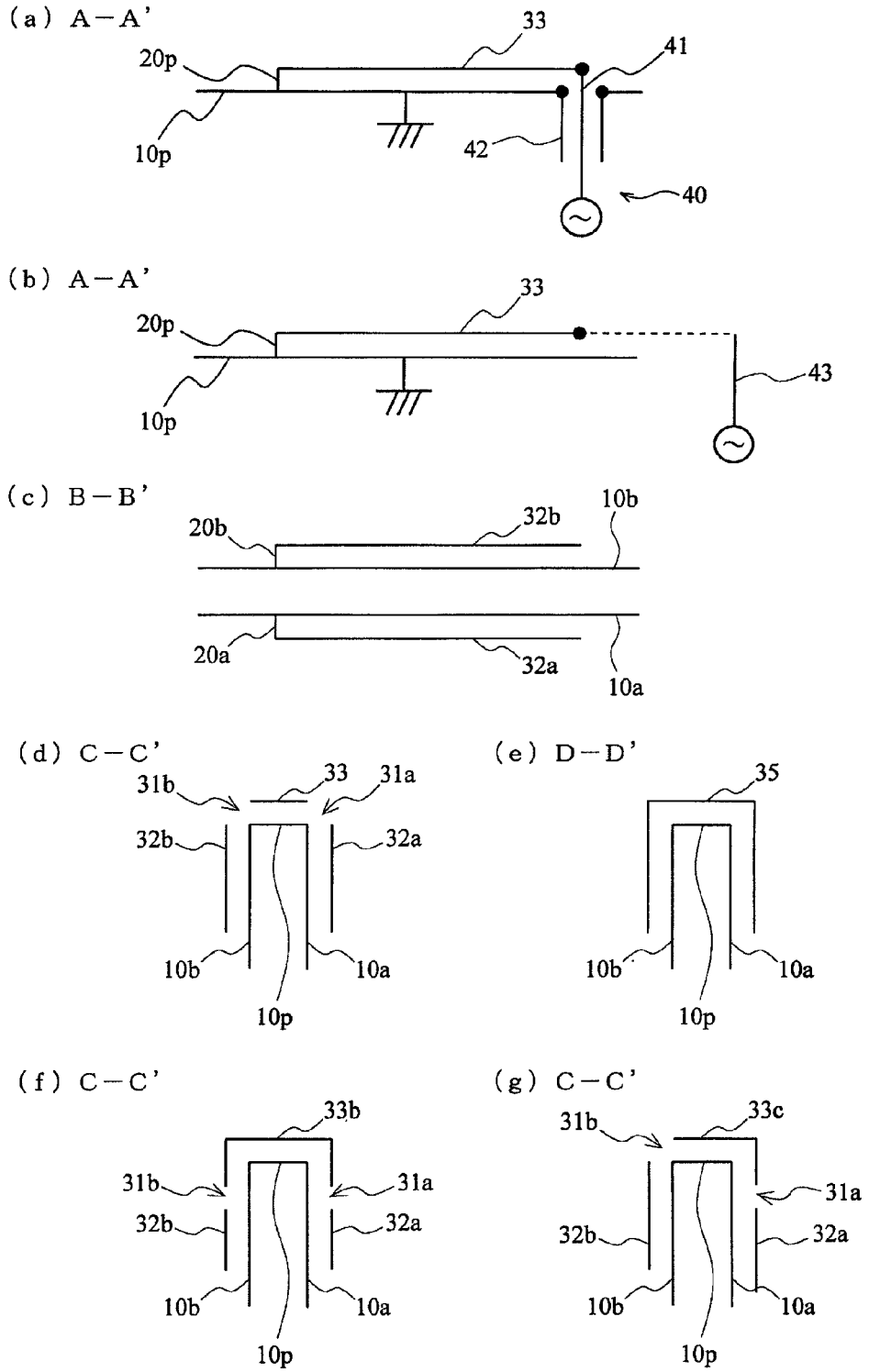
FIG. 13 shows sections of respective parts of a folding type planar inverted F antenna and its modified examples by diagrams.

FIG. 13 shows sections of respective parts of the folding type planar inverted F antenna 1 shown in FIG. 12 and modified examples thereof by diagrams.

In the planar inverted F antenna 1 of the embodiment shown in FIG. 12 and FIG. 13, it is of the type that the planar inverted F antenna 1 in the first embodiment has been folded into the U-shape in section. However, with regard to the short circuit plate 20, it is formed by being divided for every faces corresponding to the first excitation conductive plate 32*a*, the MSL 33, and the second excitation conductive plate 32*b*.

As shown in FIG. 12 and FIG. 13, the planar inverted F antenna 1 is formed with a first ground conductive plate 10*a*, a third ground conductive plate 10*p*, and a second ground conductive plate 10*b* by folding the ground conductive plate 10 into the U-shape in section.

On the other hand, the section of the base 35 is also formed into the U-shape by folding two spots of an almost central part of the slit 31*a* and an almost central part of the slit 31*b*.

Then, the first ground conductive plate 10*a* and the first excitation conductive plate 32*a* are short-circuited (connected) by a first short circuit plate 20*a*, the third ground conductive plate 10*p* and the MSL 33 are short-circuited by a third short circuit plate 20*p*, and the second ground conductive plate 10*b* and the second excitation conductive plate 32*b* are short-circuited by a second short circuit plate 20*b*.

Incidentally, in FIG. 12 and succeeding figures showing perspective states, indication of the feeding line is omitted.

However, in any of the embodiments, it is also possible to adopt the feeding line of either the through type (including a slot type) or the external type as described in the first embodiment and the second embodiment. Then, with respect to the A-A' section in that case, in the case of FIG. 12, it will be as shown in FIG. 13(*a*) if it is the through type one and will be as shown in FIG. 13(*b*) if it is the external type one.

In the respective embodiments described in FIG. 13 and succeeding figures, the feeding line is omitted and indicated in perspective views and the external type is shown in the A-A' section in the both types. However, although in the case of the external type, it is connected to the ground at an arbitrary spot of the ground conductive plate 10 as shown in FIGS. 3(*b*) and (*c*), also indication of the connection state to the ground is omitted in the A-A' sectional diagrams including FIG. 13(*b*).

Then, although with respect to the external type feeding lines shown in FIG. 13 and succeeding figures, a state in which between the feeding pin 43 and the connection point shown by a black circle is connected by a dotted line is indicated as shown in FIG. 13(*b*), this shows that any of the both types in FIGS. 3(*b*) and (*c*) is possible.

FIG. 13(*c*) shows a B-B' section of the planar inverted F antenna 1 shown in FIG. 12.

In addition, FIG. 13(*d*) shows a C-C' section of the planar inverted F antenna 1 shown in FIG. 12. In addition, FIG. 13(*e*) shows a D-D' section of the same.

On the other hand, FIGS. 13(*f*) and (*g*) show C-C' sections for modified examples of the planar inverted F antenna 1 shown in FIG. 12.

In the case of the planar inverted F antenna 1 shown in FIG. 12, in three planes formed by folding it into the U-shape, the width of the central plane is the narrowest. Therefore, a case that a width W of the central plane becomes narrower than the width w required for the characteristic impedance of the MSL 33 to attain Z=50Ω may occur depending on the design condition of the antenna. The ones coping with such the case are the modified examples shown in FIGS. 13(*f*) and (*g*).

In the modified example in FIG. 13(*f*), it has been folded at two spots on the MSL 33 part, not folded at the parts on the slits 31*a* and 31*b*.

In addition, in the modified example in FIG. 13(*g*), it has been folded at one spot on the MSL 33 part and at two spots on the slit 31*b* part.

In either case, it is necessary that the distances from the MSL 33 to the first ground conductive plate 10*a*, the second ground conductive plate 10*b*, and the third ground conductive plate 10*p* should be constant. However, if the characteristic impedance of the MSL 33 is Z, the distances may not necessarily be constant.

As described above, according to the folding type planar inverted F antenna 1, it becomes possible to arrange the planar inverted F antenna 1 in a narrower region by arranging a circuit board of the electronic equipment such as the mobile phone or the like in an inner part which has been formed into the U-shape or L-shape in section of the ground conductive plate 10.

In addition, according to the planar inverted F antenna 1 of the present embodiment, it is formed into the U-shape in section and the first excitation conductive plate 32*a* and the second excitation conductive plate 32*b* are arranged on mutually parallel surfaces. Thus, even in a case where the circuit and the structure of the electronic equipment have been housed within the ground conductive plate 10 which is U-shaped in section, the radiation apertures (the first excitation conductive plate 32*a* and the second excitation conductive plate 32*b*) of the antenna can be arranged on the both of rear and front surface sides of the electronic equipment.

As a result, radiation from the both of the rear and front surfaces of the electronic equipment becomes possible and radiation characteristics are improved.

Figure 14:
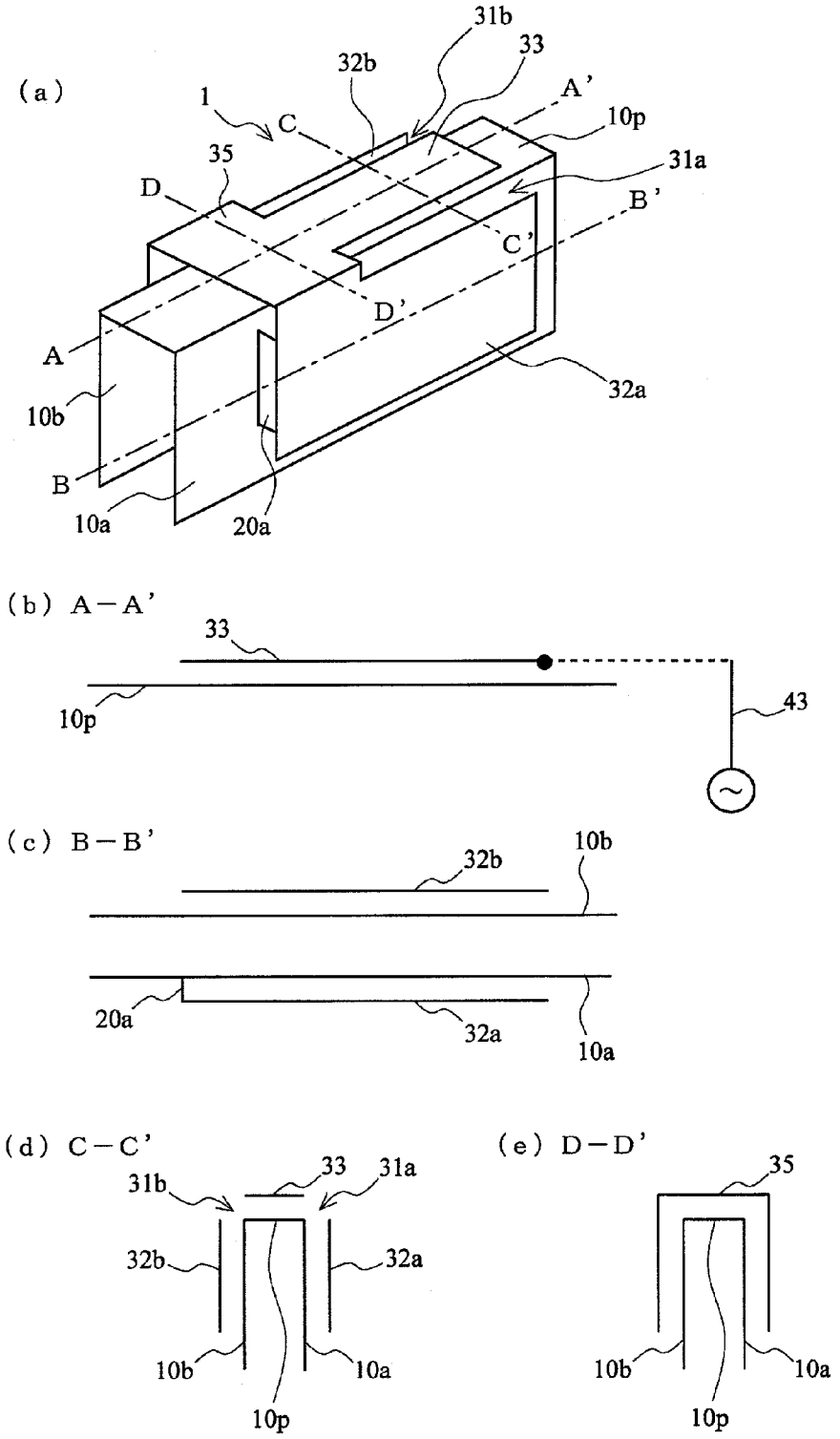
FIG. 14 shows a perspective state and respective sections concerning a structure of a folding planar inverted F antenna pertaining to another embodiment by diagrams.

FIG. 14 shows a perspective state and respective sections concerning a structure of a folding planar inverted F antenna 1 pertaining to another embodiment by diagrams.

In the folding planar inverted F antenna 1 described in FIG. 12, all of the first excitation conductive plate 32*a*, the MSL 33 and the second excitation conductive plate 32*b* are connected to the ground conductive plate 10 respectively by the first short circuit plate 20*a*, the third short circuit plate 20*p* and the second short circuit plate 20*b*.

In contrast, in the present embodiment, as shown in FIG. 14(*a*), the main conductive plate 30 and the ground conductive plate 10 simply connect the first excitation conductive plate 32*a* and the first ground conductive plate 10*a* by the first short circuit plate 20*a*.

Incidentally, not limited to the embodiment in FIG. 14, connection (short circuiting) of the ground conductive plate 10 with the main conductive plate 30 may be made by any one or arbitrary two of the first short circuit plate 20*a*, the second short circuit plate 20*b* and the third short circuit plate 20*p* so as to connect at one or two spot(s), and further they may be connected at all spots.

Figure 15:
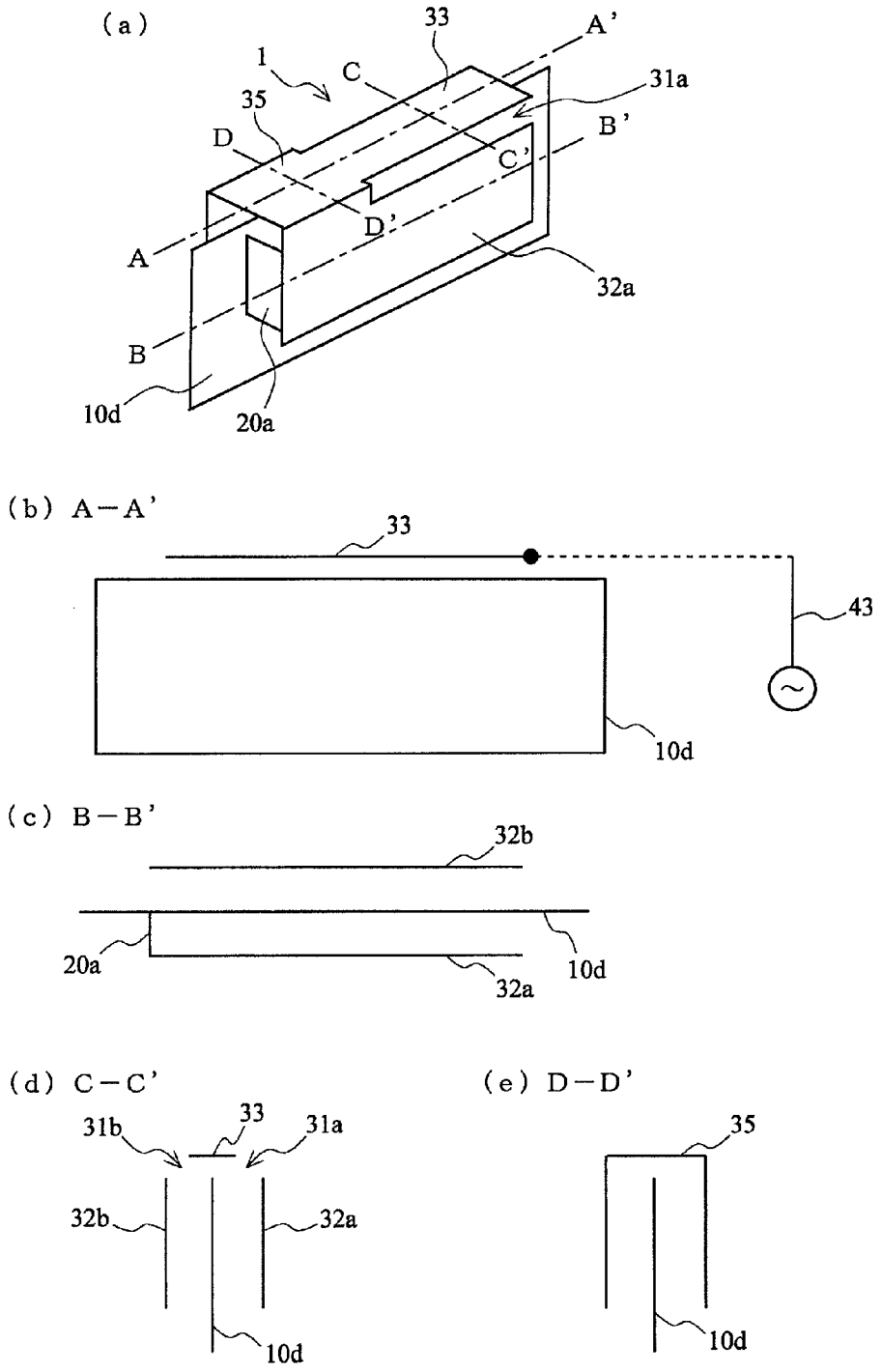
FIG. 15 shows a perspective state and respective sections concerning a structure of a folding planar inverted F antenna pertaining to another embodiment by diagrams.

FIG. 15 shows a perspective state and respective sections concerning a structure of a folding planar inverted F antenna 1 pertaining to another embodiment by diagrams.

In this embodiment, the main conductive plate 30 has been folded into the U-shape such that one fourth ground conductive plate 10*d* is installed between the first excitation conductive plate 32*a* and the second excitation conductive plate 32*b* in parallel.

As shown in FIGS. 15(*a*) and (*c*), although in this embodiment, the first excitation conductive plate 32*a* and the fourth ground conductive plate 10*d* are connected together by the first short circuit plate 20*a*, the second excitation conductive plate 32*b* and the fourth ground conductive plate 10*d* may be connected together by the first short circuit plate 20*a* and both of them may be connected together.

According to this embodiment, the folding planar inverted F antenna 1 can be thinned.

However, in order to ensure the width w of the MSL 33, the main conductive plate 30 may be folded at one or two spots on the MSL 33 as described in FIGS. 13(*f*) and (*g*) depending on the design condition of the folding planar inverted F antenna 1.

Figure 16:
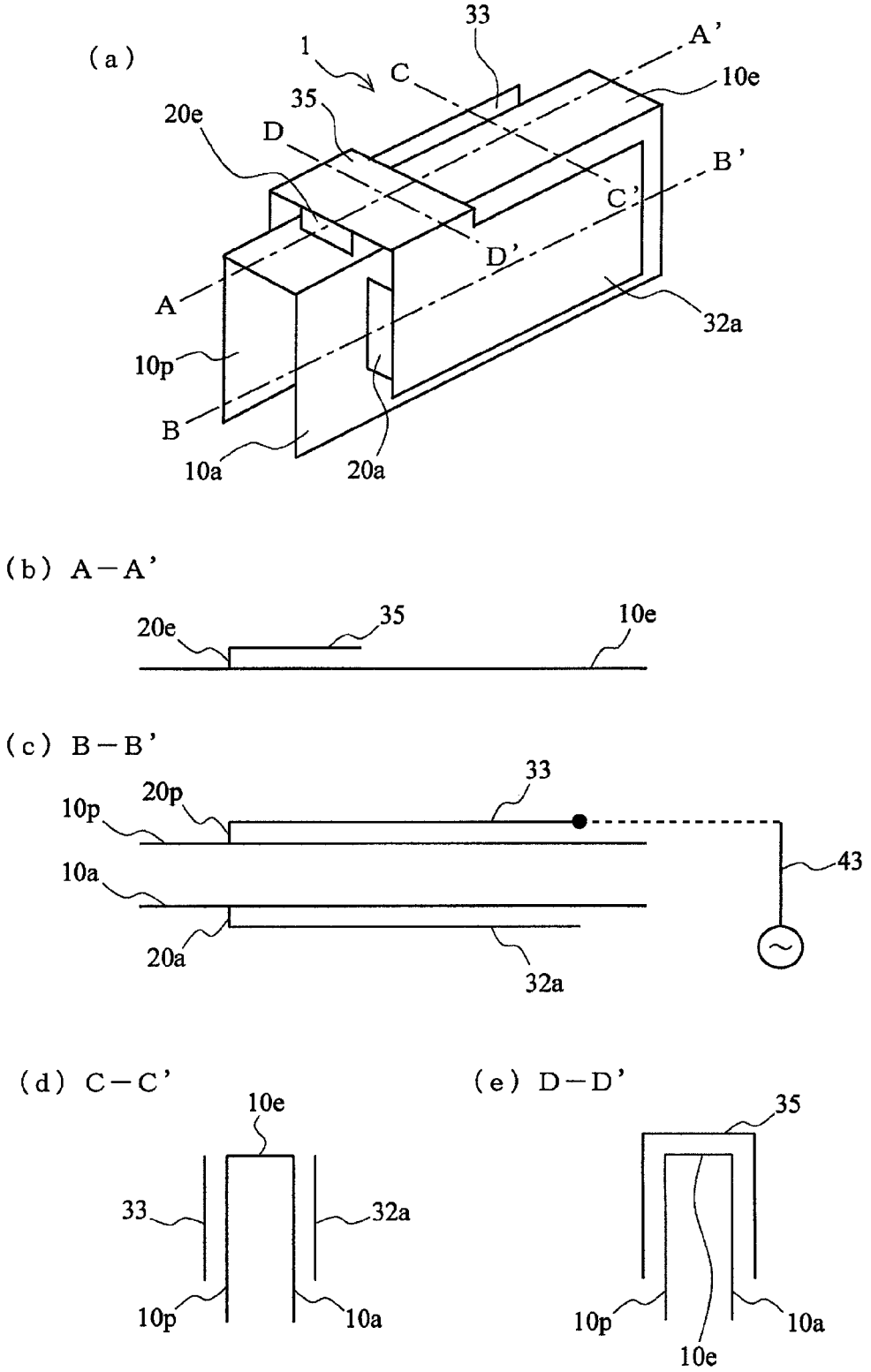
FIG. 16 shows a perspective state and respective sections concerning a structure of a folding planar inverted F antenna pertaining to another embodiment by diagrams.

FIG. 16 shows a perspective state and respective sections concerning a structure of a folding planar inverted F antenna 1 pertaining to another embodiment by diagrams.

In this embodiment, the first excitation conductive plate 32*a* is singly used as the excitation conductive plate, and it has been formed so as to make the MSL 33 parallel with the first excitation plate 32*a*.

That is, as shown in FIG. 16, the ground conductive plate 10 which has been folded into the U-shape is defined as the first ground conductive plate 10*a*, a fifth ground conductive plate 10*e* and the third ground conductive plate 10*p* in order.

On the other hand, a wide slit is formed at one spot in the central part of the main conductive plate 30, one side thereof is defined as the first excitation plate 32*a* and the other side thereof is defined as the MSL 33 and it is folded at two spots on a part of the base 35 where the slit is formed.

Then, the first excitation plate 32*a* and the first ground conductive plate 10*a* are connected together by the first short circuit plate 20*a*, the base 35 corresponding to the slit part and the fifth ground conductive plate 10*e* are connected together by a fifth short circuit plate 20*e*, and the MSL 33 and the third ground conductive plate 10*p* are connected together by a third short circuit plate 20*p*.

According to the folding planar inverted F antenna 1 of the present embodiment, since the MSL 33 is arranged in parallel with the first excitation conductive plate 32*a*, thinning can be implemented by narrowing the width of the fifth ground conductive plate 10*e*.

Incidentally, the first ground conductive plate 10*a* and the third ground conductive plate 10*p* may be commonalized as one ground conductive plate 10. The single ground conductive 10 in this case is made the same as the fourth ground conductive plate 10*d* described in FIG. 15 and the fifth short circuit plate 20*e* becomes unnecessary.

In addition, in the present embodiment and modified examples, connection (short-circuiting) of the main conductive plate 30 with the ground conductive plate 10 may be also configured to short-circuit them at any one spot.

Figure 17:
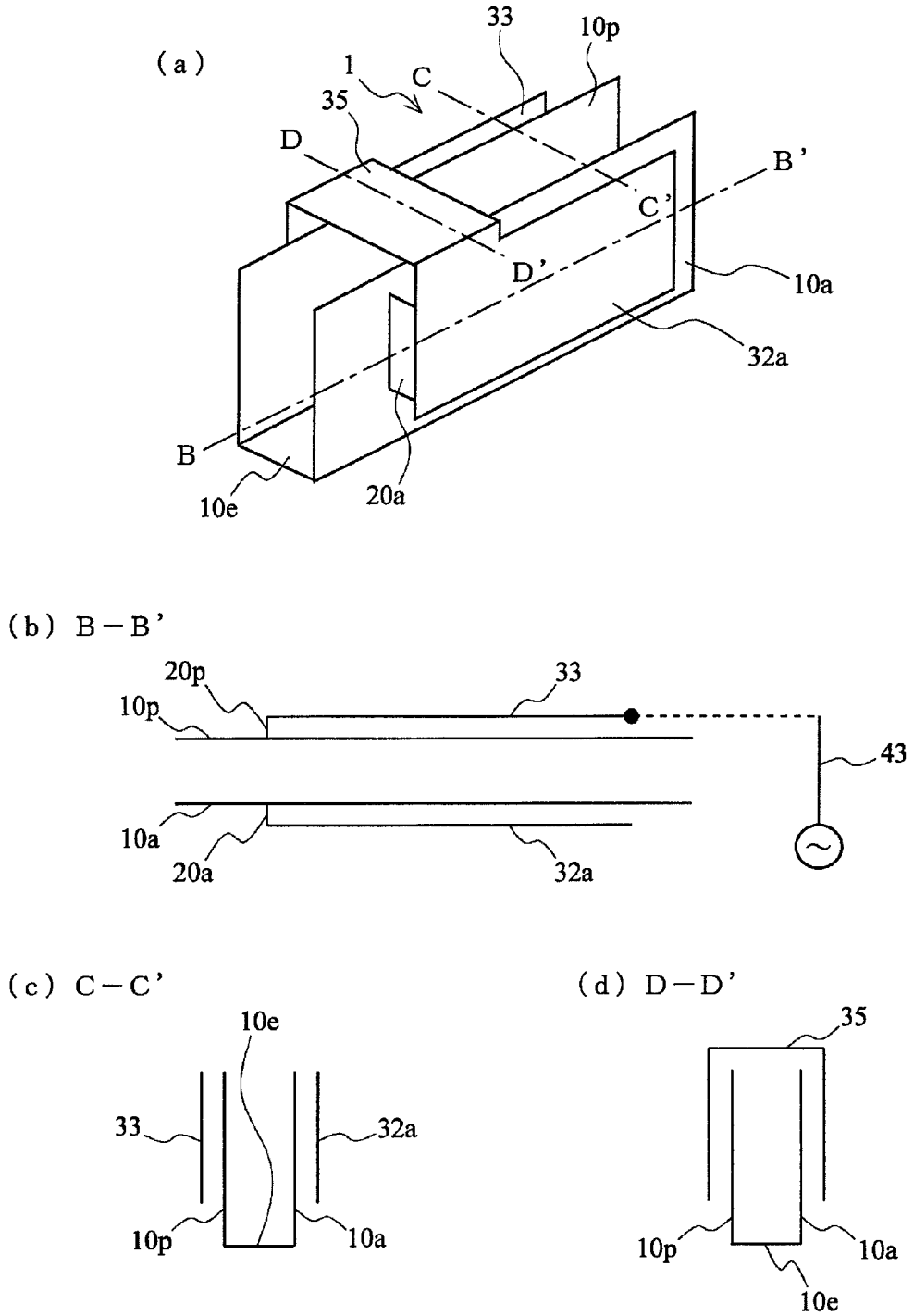
FIG. 17 shows a perspective state and respective sections concerning a structure of a folding planar inverted F antenna pertaining to another embodiment by diagrams.

FIG. 17 shows a perspective state and respective sections concerning a structure of a folding planar inverted F antenna 1 pertaining to another embodiment by diagrams.

In this embodiment, the orientation of the ground conductive plate 10 in the folding planar inverted F antenna 1 described in FIG. 16 has been inverted.

That is, it is the one that the open side of the main conductive plate 30 which has been also formed into the U-shape in section is inserted from the open side of the ground conductive plate 10 which has been formed into the U-shape in section. This folding planar inverted F antenna 1 is of a configuration which becomes possible because the MSL 33 has been arranged not on the central part of the base 35 but on its end in parallel with the first excitation conductive plate 32*a*.

Also this embodiment makes it possible to omit any one of the first short circuit plate 20*a* and the third short circuit plate 20*p*.

Figure 18:
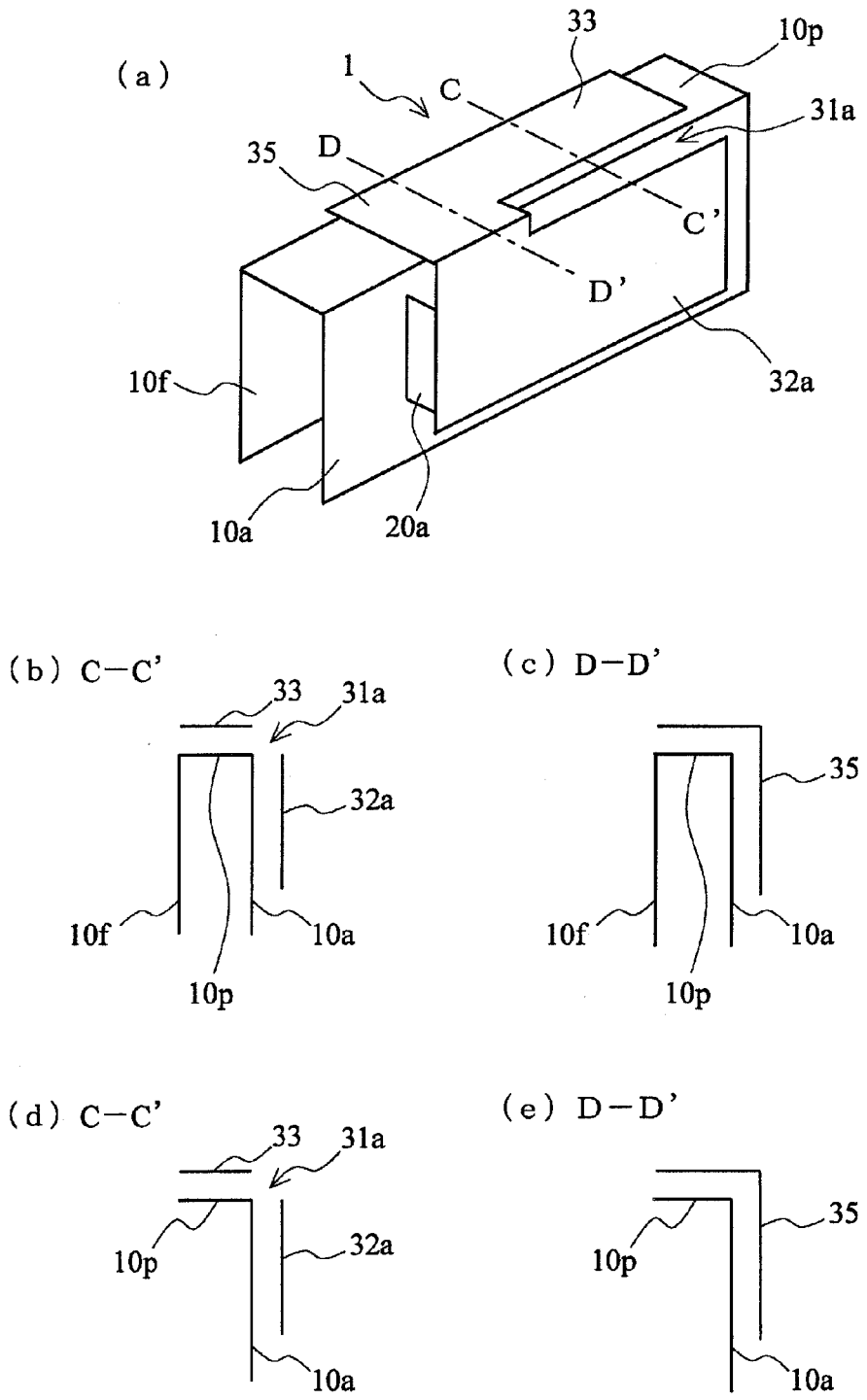
FIG. 18 shows a perspective state and respective sections concerning a structure of a folding planar inverted F antenna pertaining to another embodiment by diagrams.
Figure 19:
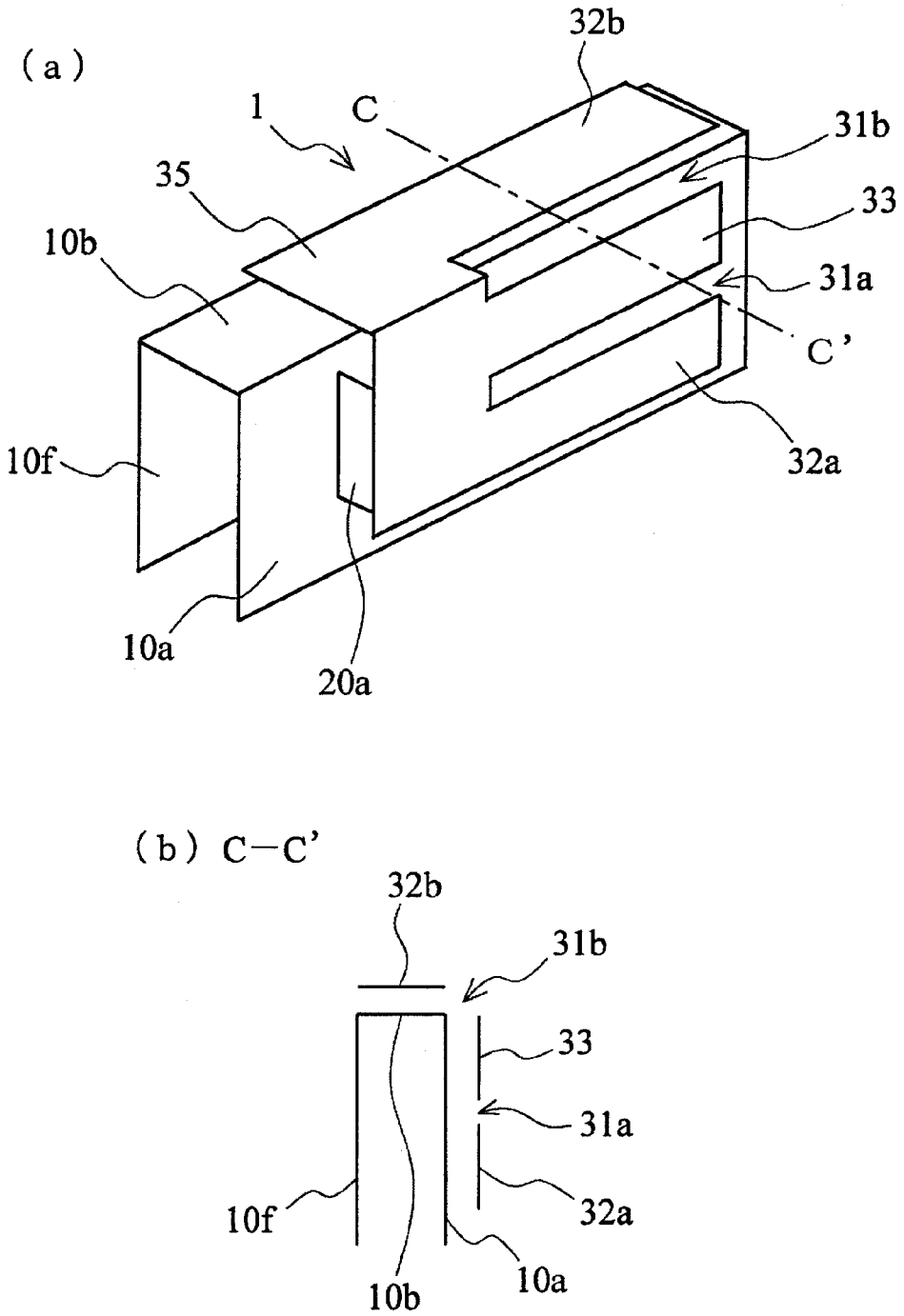
FIG. 19 shows a perspective state and a section concerning a structure of a folding planar inverted F antenna pertaining to another embodiment by diagrams.

FIGS. 18 and 19 show perspective states and respective sections concerning structures of folding planar inverted F antennas 1 pertaining to other embodiments by diagrams.

The folding planar inverted F antennas 1 shown in FIG. 18 and FIG. 19 are of the kind that the main conductive plate 30 has been formed into the L-shape in section by folding it only at one spot.

The folding planar inverted F antenna 1 in FIG. 18 is of the configuration which is the same as that of a state that the second excitation conductive plate 32*b* has been cut off at the slit 31*b* part in the folding planar inverted F antenna 1 shown in FIG. 14.

According to the folding planar inverted F antenna 1 of this embodiment, thinning is possible just as much as the second excitation conductive plate 32*b* is eliminated.

FIGS. 18(*b*) and (*c*) show a C-C' section and a D-D' section in FIG. 18(*a*) by diagrams.

On the other hand, FIGS. 18 (*d*) and (*e*) show the C-C' section and the D-D' section (the sections of the same places as those in FIG. 18(*a*)) of a folding planar inverted F antenna 1 in a modified example of the present embodiment by diagrams.

In this modified example, also the ground conductive plate 10 of the folding planar inverted F antenna 1 has been configured similarly to a state that the second ground conductive plate 10*b* part has been cut off. That is, also the ground conductive plate 10 has been configured into the L-shape in section similarly to the main conductive plate 30.

According to this modified example, since a part facing the first ground conductive plate 10*a* is opened, even in a case where the thickness of the electronic equipment is thick, it becomes possible to arrange it along its outer peripheral surface. That is, there is such an effect that the degree of freedom in arrangement place is raised.

FIG. 19 shows a perspective state and a section concerning a structure of a folding planar inverted F antenna 1 pertaining to another embodiment by diagrams.

In this embodiment, similarly to that described in the first embodiment, the main conductive plate 30 that the slits 31*a* and 31*b* are formed on the both sides of the MSL 33 is used and has been folded at one spot on the slit 31*b* part.

In the present embodiment, the first excitation conductive plate 32*a* and the second excitation conductive plate 32*b* can be arranged on orthogonal surfaces.

Incidentally, also in the present embodiment, similarly to the modified example shown in FIGS. 18(*d*) and (*e*), it is also possible to raise the degree of freedom in arrangement place of the folding planar inverted F antenna 1 by forming the ground conductive plate 10 into the L-shape in section.

Also in this embodiment, it is possible to shift the connection spot of the ground conductive plate 10 with the main conductive plate 30 to another position.

Next, in the folding planar inverted F antenna 1, a folding planar inverted F antenna 1 which has been made compatible with multifrequency will be described.

Figure 20:
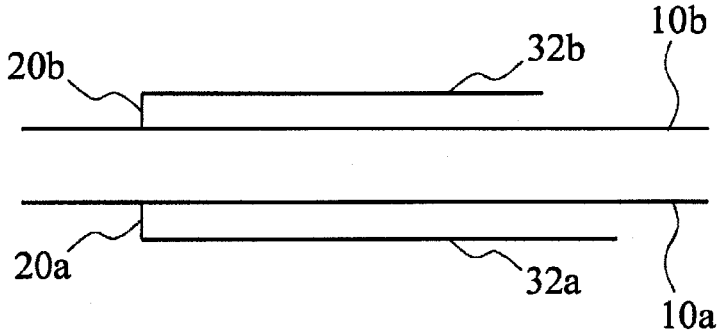
FIG. 20 shows respective sections concerning a structure of a folding planar inverted F antenna which has been made compatible with multifrequency by diagrams.
Figure 20:
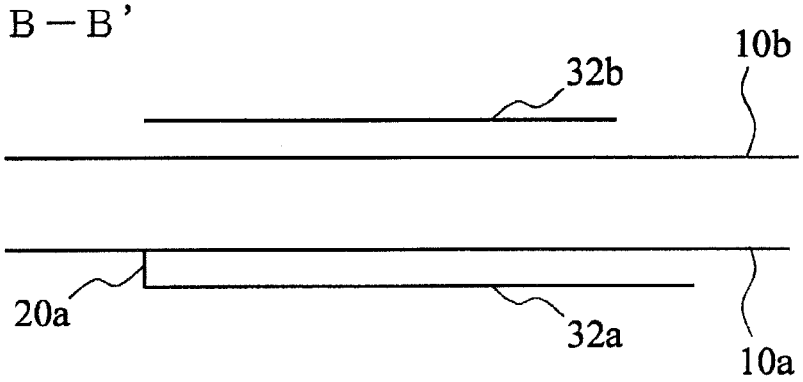
Figure 20:
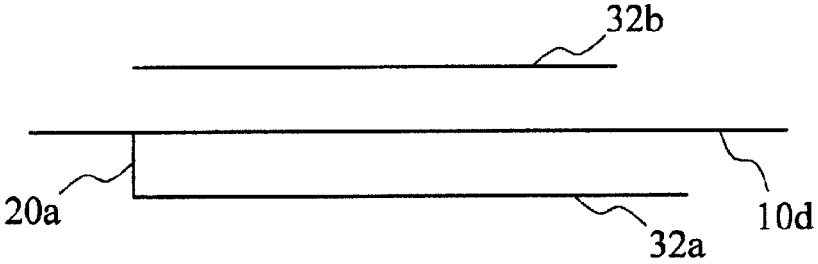

FIG. 20 shows respective sections concerning a structure of a folding planar inverted F antenna 1 which has been made compatible with multifrequency by diagrams.

In this embodiment, multifrequency performance is enabled by changing the lengths of the first excitation conductive plate 32*a* and the second excitation conductive plate 32*b* in the folding planar inverted F antennas 1 respectively described in FIG. 12, FIG. 14 and FIG. 15.

FIGS. 20(*a*), (*b*) and (*c*) respectively correspond to the respective B-B' sections in FIG. 13(*c*), FIG. 14(*c*) and FIG. 15(*c*).

Incidentally, although in FIGS. 20(*b*) and (*c*), the first short circuit plate 20*a* is connected only to the first excitation conductive plate 32*a* side which has been formed long in length, the second short circuit plate 20*b* may be connected to the second excitation conductive plate 32*b* which has been formed short.

Figure 21:
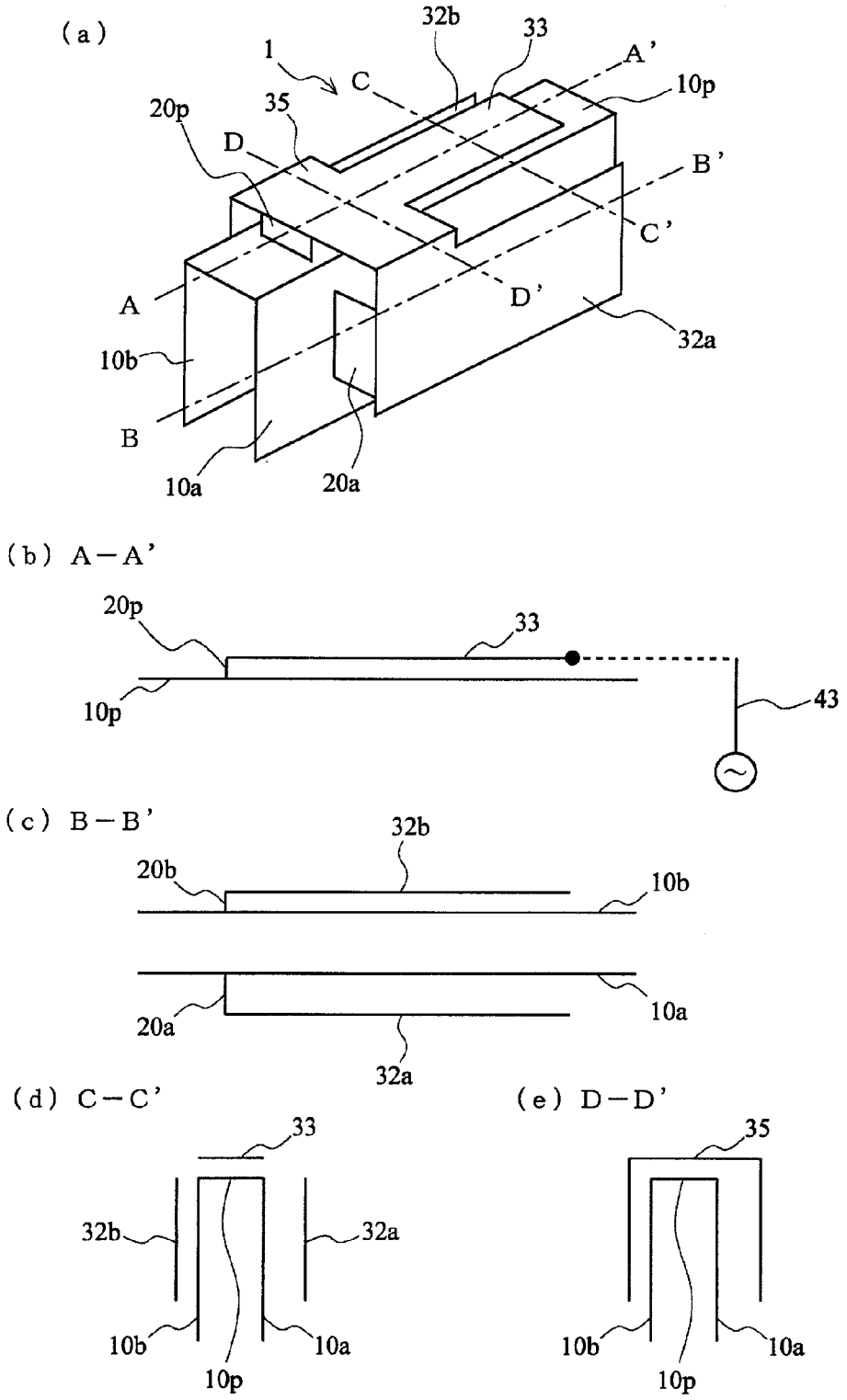
FIG. 21 shows a perspective state and respective sections concerning a structure of a folding planar inverted F antenna which has been made compatible with multifrequency pertaining to another embodiment by diagrams.

FIG. 21 shows a perspective state and respective sections concerning a structure of a folding planar inverted F antenna 1 which has been made compatible with multifrequency pertaining to another embodiment by diagrams.

This embodiment has been made compatible with multifrequency by making a difference between the distance of the first excitation conductive plate 32*a* and the distance of the second excitation conductive plate 32*b* relative to the ground conductive plate 10 similarly to the embodiments shown in FIG. 8 and FIG. 9 by displacing the arrangement position of the ground conductive plate 10 relative to the main conductive plate 30 which has been folded into the U-shape in a thickness direction.

Incidentally, a multifrequency compatible folding planar inverted F antenna 1 may be configured by folding the first excitation conductive plate 32*a* or the second excitation conductive plate 32*b* at the line S part where the input impedance becomes Z in a direction closer to or apart from the ground conductive plate 10 as shown in FIG. 8 for the folding planar inverted F antenna 1 shown in FIG. 12.

In addition, as described in FIG. 8, one of the first excitation conductive plate 32*a* and the second excitation conductive plate 32*b* may be folded in the direction closer to the ground conductive plate 10 and the other may be folded in the direction apart therefrom for the folding planar inverted F antenna 1 shown in FIG. 12.

Figure 22:
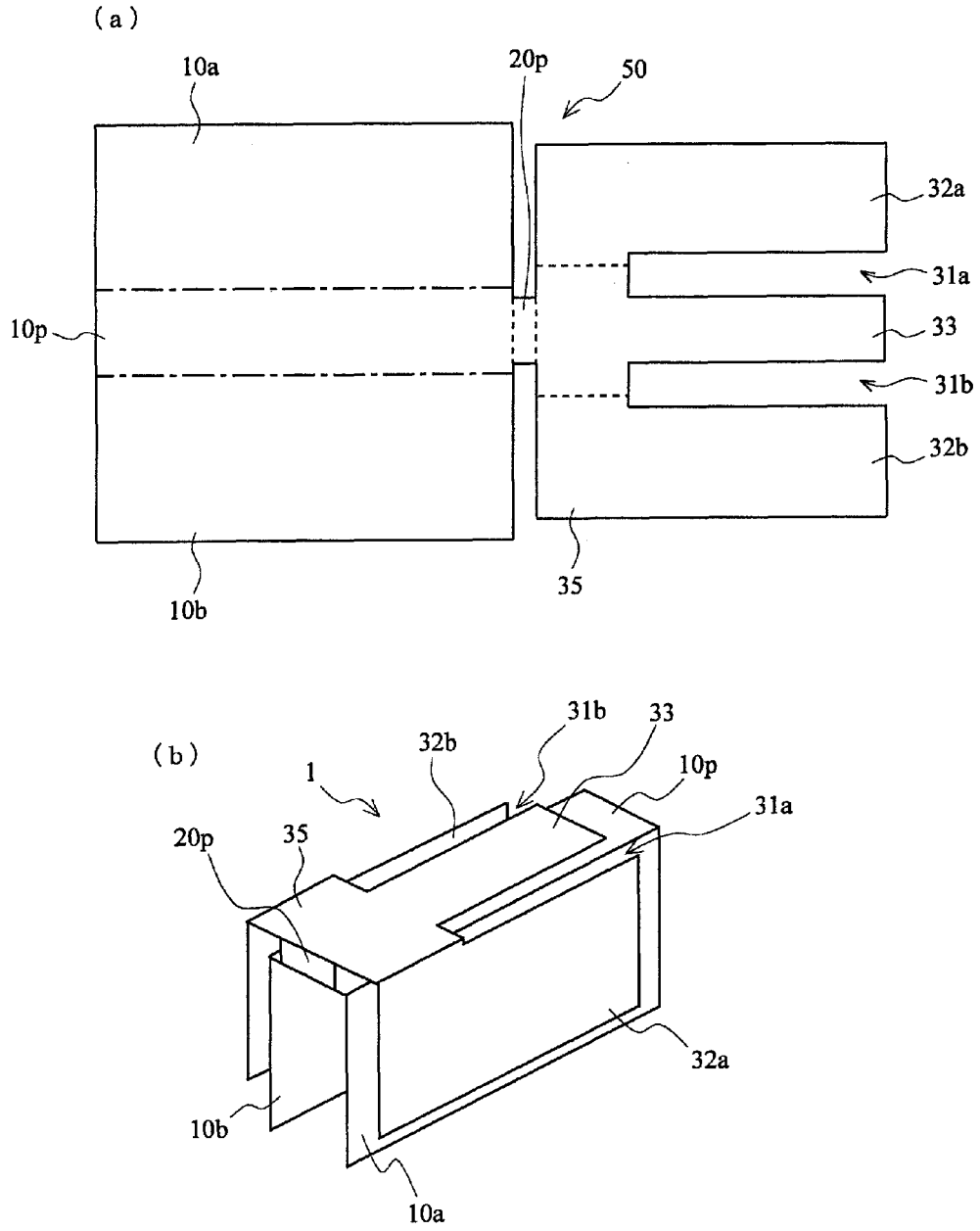
FIG. 22 shows a structure of a folding planar inverted F antenna pertaining to another embodiment and a developed state thereof by diagrams.

FIG. 22 shows a structure of a folding planar inverted F antenna 1 pertaining to another embodiment and a developed state thereof by diagrams.

In the folding planar inverted F antennas 1 described in FIG. 12 to FIG. 21, each short circuit plate 20 is connected to the prescribed distance u (u<x−a: see FIG. 2 for x, a) from the end face of the ground conductive plate 10 by welding or the like.

In contrast, in the folding planar inverted F antenna 1 of the present embodiment, each short circuit plate 20 (the third short circuit plate 20*p* in FIG. 22) is made to be connected with the end of the ground conductive plate 10 (the third ground conductive plate 10*p* in FIG. 22).

Although also in connection of the third short circuit plate 20*p* with the third ground conductive plate 10*p* in the case in FIG. 22, both of them may be formed separately and may be connected together by welding, the ground conductive plate 10, the short circuit plate 20 and the main conductive plate 30 may be formed integrally by punching or cutting the conductive member 50 using the metal such as brass or the like as shown in FIG. 22(*a*).

Then, from the developed state shown in FIG. 22(*a*), the both sides of the third ground conductive plate 10*p* are mountain-folded at one-point chain line parts and the both sides of the third short circuit plate 20*p* are valley-folded at dotted line parts.

Further, the folding planar inverted F antenna 1 shown in FIG. 22(*b*) is formed by valley-folding the dotted line parts corresponding to the slits 31*a* and 31*b* in the base 35.

Incidentally, although in FIG. 22, description has been made with respect to a state that a through-hole is not formed in the third ground conductive plate 10*p* on the premise of the folding planar inverted F antenna 1 of the external type as the feeding line, in a case where a through type folding planar inverted F antenna 1 is to be formed, the through-hole 11 is formed in a corresponding point of the third ground conductive plate 10*p*.

Also with respect to the folding planar inverted F antennas 1 of the respective embodiments described in FIG. 12 to FIG. 21, the ground conductive plate 10, the short circuit plate 20, and the main conductive plate 30 may be integrally formed similarly by punching or the like and formed by folding as a planar inverted F antenna 1 which has been modified to the type that the short circuit plate 20 is connected to the end of the ground conductive plate 10.

Figure 23:
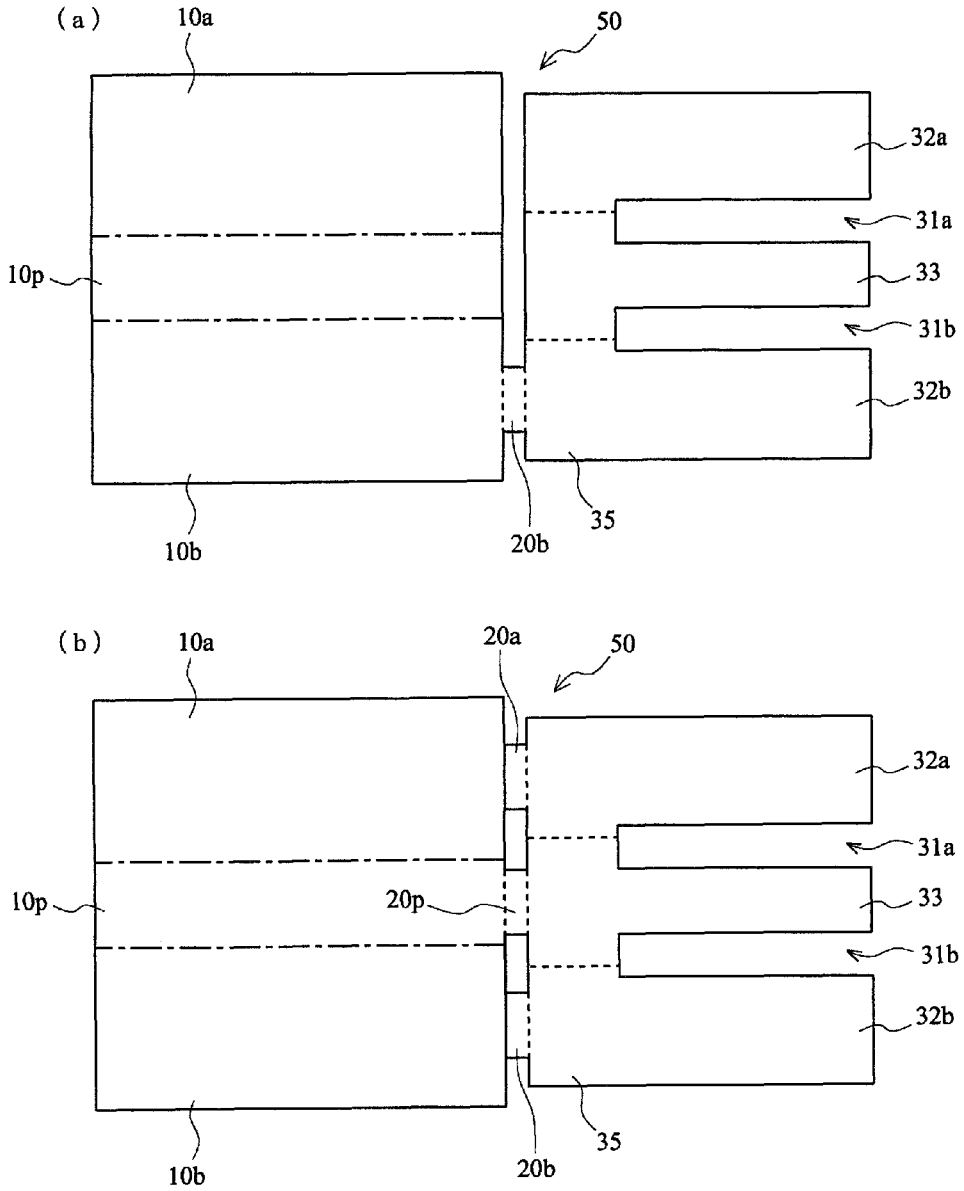
FIG. 23 shows development views in a case where folding planar inverted F antennas are integrally formed by punching similarly.

FIGS. 23(*a*) and (*b*) show development elevations of a case that the folding planar inverted F antennas 1 respectively described in FIG. 14 and FIG. 12 are to be integrally formed similarly by punching.

In the case of the folding planar inverted F antennas 1 shown in FIG. 22 and FIG. 23(*a*), although connection of the ground conductive plate 10 with the main conductive plate 30 is connected at any one spot on the U-shape (the third short circuit plate 20*p* in FIG. 22 and the second short circuit plate 20*b* in FIG. 23(*a*)), they may be configured to be connected together at arbitrary two of three spots and at the three spots.

FIG. 23(*b*) is an example that the short circuit plate 20 is connected at three spots on the U-shape.

As shown in FIG. 23(*b*), in the case of integrally forming the folding type planar inverted F antenna 1 by punching or the like, in a case where the ground conductive plate 10 and the main conductive plate 30, and the short circuit plate 20 are to be connected at two or more spots on the U-shape, the both sides of any one of the short circuit plates 20 are integrally processed to be contiguous to the ground conductive plate 10 and the main conductive plate 30. On the other hand, with respect to the remaining short circuit plates 20, each is integrally processed to be contiguous to any one side of the ground conductive plate 10 and the main conductive plate 30, and the other side is cut off.

In the example in FIG. 23(*b*), the third short circuit plate 20*p* is formed integrally with the third ground conductive plate 10*p* and the MSL 33, the first short circuit plate 20*a* is formed integrally with the first excitation conductive plate 32*a*, and the second short circuit plate 20*b* is formed integrally with the second excitation conductive plate 32*b*.

On the other hand, the first short circuit plate 20*a* and the first ground conductive plate 10*a* are separated from each other, and the second short circuit plate 20*b* and the second ground conductive plate 10*b* are separated from each other. With respect to between the first short circuit plate 20*a* and the first ground conductive plate 10*a* and between the second short circuit 20*b* and the second ground conductive plate 10*b* which are mutually separated, their other sides are valley-folded at the dotted line parts and thereafter they are connected together by welding or the like.

Figure 24:
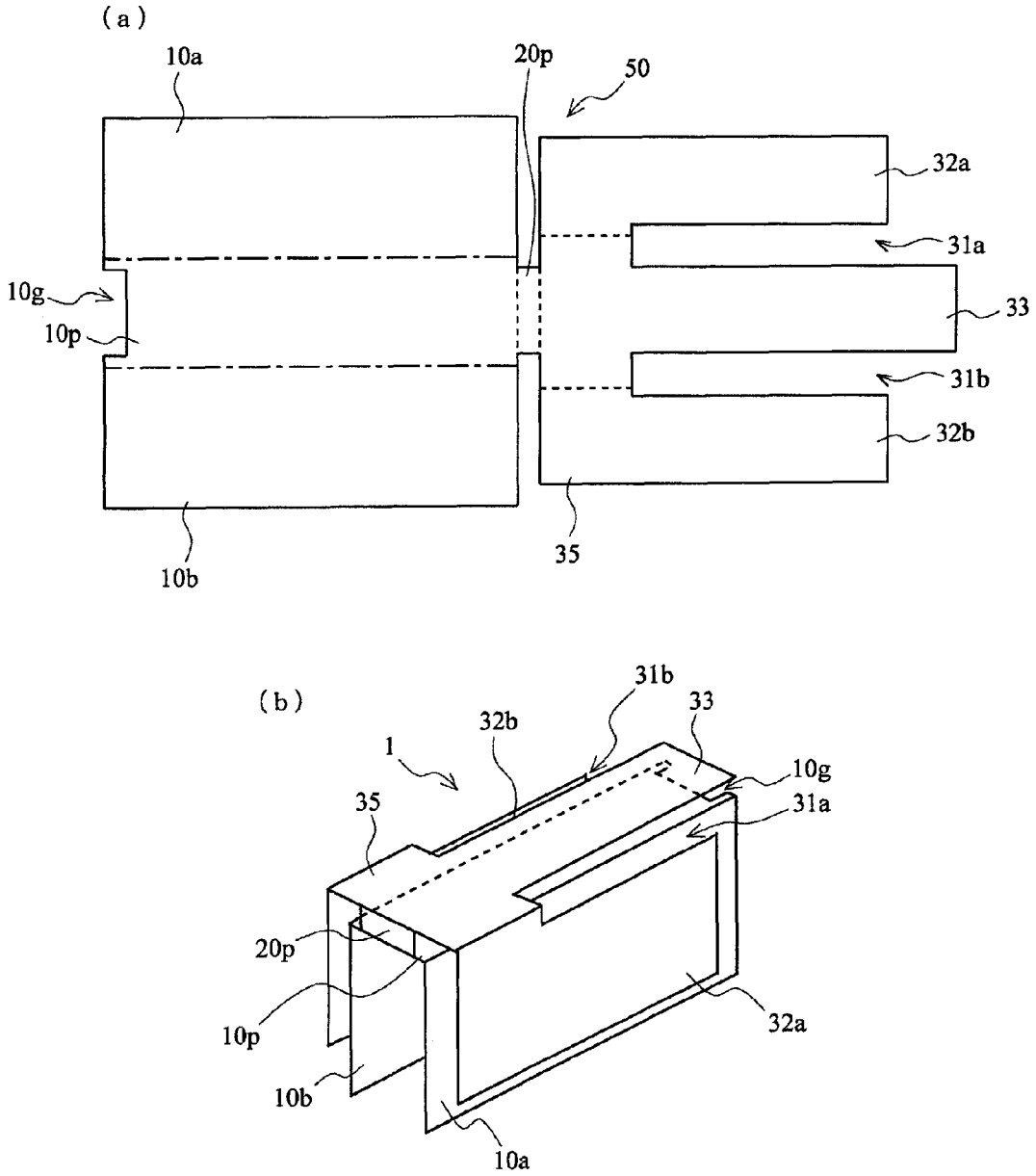
FIG. 24 shows a structure of a folding planar inverted F antenna pertaining to another embodiment and a developed state thereof by diagrams.
Figure 25:
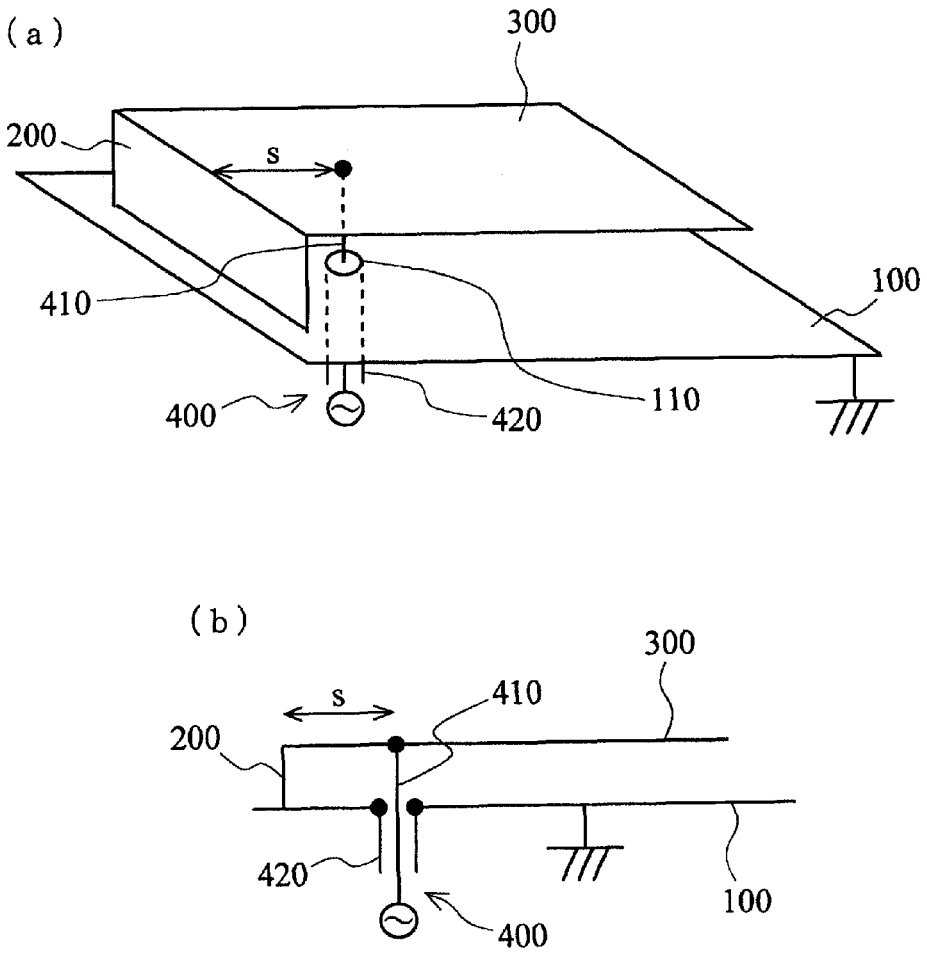
FIG. 25 is a structure diagram of a conventional planar inverted F antenna.

FIG. 24 shows a structure of a folding planar inverted F antenna 1 pertaining to another embodiment and a developed state thereof by diagrams.

Although the folding planar inverted F antenna 1 of this embodiment is also the one which has been integrally formed by punching or the like, it is of a configuration that the feeding line of the external type described in FIG. 3(*c*) is laid. That is, the structure is such that the coaxial line 40 is used as the feeding line, the feeding pin 41 is connected to the open end of the MSL 33 with no provision of the through-hole 11, and the external conductor 42 is connected to the ground conductive plate 10.

Specifically, as shown in FIG. 24(*a*), the length of the MSL 33 is formed to be the same as the length of the first ground conductive plate 10*a* (the second ground conductive plate 10*b*), and a notch part 10*g* is formed in the open end side (the left side in the figure) of the third ground conductive plate 10*p*. It is preferable that the depth (in the length direction of the MSL 33) of this notch be set to about the radius of the coaxial line 40 to be connected.

However, it is also possible to make the lengths of the MSL 33 and the first ground conductive plate 10*a* (the second ground conductive plate 10*b*) the same as each other to make the positions of the open ends of the both the same as each other with no provision of the notch part 10*g*. In this case, the external conductor 42 of the coaxial line 40 is connected to the ground conductive plate 10 at a position where a prescribed space of such extent that the feeding pin 41 is not in contact with the ground conductive plate 10 is left and the tip of the feeding pin 41 is slightly bent and is welded to the MSL 33.

Incidentally, although in the folding planar inverted F antenna 1 described above, a case that one or two spot(s) is/are folded along the longitudinal direction of the slit has been described, it may be folded at three or more spots.

For example, in a case where three spots are folded in the same direction along the longitudinal direction of all the slits, the section becomes rectangularity, and the section takes the ladle-like shape by folding adjacent two spots in the same direction and the remaining one spot in the opposite direction.

In addition, one or a plurality of spot(s) may be folded in the longitudinal direction of the slit and the other one or plurality of spot(s) may be folded in a direction (for example, an orthogonal direction) intersecting with the longitudinal direction of the slit.

Further, although a case that it has been folded to 90 degrees as the folding angle has been described, it is also possible to fold it to not less than 90 degrees and it is further possible to fold it to not more than 90 degrees depending on the shape of the arrangement region of the communication equipment relative to the folding planar inverted F antenna 1.

Although description has been made about the present embodiments as mentioned above, it is also allowed to adopt the following configurations.

(1) Structure 1

A planar inverted F antenna, comprising a ground conductive plate to be connected to the ground, a short circuiting member connected to said ground conductive plate, and a main conductive plate to the side of one end of which said short circuiting member is connected, said main conductive plate, comprising: one or a plurality of slit(s) formed from the other end on the side opposite to the side to which said short circuiting member has been connected up to a position where an input impedance of the antenna becomes Z; a microstrip line which is formed between a side end of said main conductive plate and said one slit, or between adjacent slits in said plurality of slits with a width w that a characteristic impedance becomes Z and to which a feeding line is to be connected; and one or a plurality of excitation conductive plate(s) formed on a side of said slit to which said microstrip line is not adjacent.

(2) Structure 2

The planar inverted F antenna according to structure 1, wherein said ground conductive plate, said short circuiting member and said main conductive plate are integrally formed from one mutually contiguous conductive plate and are formed by being folded in the same direction at a connection part of said ground conducive plate with said short circuiting member and a connection part of said short circuiting member with said main conductive plate.

(3) Structure 3

The planar inverted F antenna according to structure 1 or structure 2, wherein said slits are formed by two at positions on both sides equally spaced from a width-wise center of said main conductive plate, by which the microstrip line is formed on the center of said main conductive plate, and a first excitation conductive plate and a second excitation conductive plate are formed on both sides thereof.

(4) Structure 4

The planar inverted F antenna according to structure 3, wherein said first excitation conductive plate and said second excitation conductive plate are formed to have different lengths.

(5) Structure 5

The planar inverted F antenna according to structure 3, wherein said first excitation conductive plate and said second excitation conductive plate are formed to have different spaces in space with said ground conductive plate.

(6) Structure 6

The planar inverted F antenna according to any one of structure 1 to structure 5, wherein a through-hole for feeding line is formed in said ground conductive plate at a position corresponding to an open end of said microstrip line.

(7) Structure 7

The planar inverted F antenna according to structure 6, wherein said through-hole is formed into a slit-shape in a longitudinal direction of said microstrip line, and a plurality of through-holes or a slit-shape through-hole are/is formed in said microstrip lines at a position facing said through-hole.

(8) Structure 8

The planar inverted F antenna according to structure 6, wherein said through-hole is formed into a slit-shape in a longitudinal direction of said microstrip line, and a plurality of grooves in a direction intersecting with said longitudinal direction are formed in said microstrip line at a position facing said through-hole.

DESCRIPTION OF REFERENCE NUMERALS OR SYMBOLS

1 planar inverted F antenna, folding planar inverted F antenna
10 ground conductive plate
10*a* first ground conductive plate
10*b* second ground conductive plate
10*p* third ground conductive plate
20 short circuit plate
20*a* first short circuit plate
20*b* second short circuit plate
20*p* third short circuit plate
30 main conductive plate
31*a*, 31*b* slit
32*a* first excitation conductive plate
32*b* second excitation conductive plate
33 microstrip line (MSL)
40 coaxial line
41 feeding pin (central conductor)
42 external conductor
43 feeding pin

What is claimed is:

1. A planar inverted F antenna, comprising:

a ground conductive plate folded at one or a plurality of point(s) along a prescribed direction and configured to be connected to ground, a main conductive plate folded at one or two point(s) in the same direction as the prescribed direction, and a short circuiting member for connecting the ground conductive plate and the main conductive plate at one or a plurality of point(s) along one end of the main conductive plate in the prescribed direction, wherein the main conductive plate comprises:

one or a plurality of slit(s) formed from another end of the main conductive plate opposite to the one end to which the short circuiting member is connected up to a position where an input impedance of the antenna becomes Z;

a microstrip line to which a feeding line is configured to be connected, the microstrip being formed between a side of the main conductive plate and the one slit, or between adjacent slits of the plurality of slits, and having a width such that a characteristic impedance becomes Z; and one or a plurality of excitation conductive plate(s) formed on a side of the slit to which the microstrip line is not adjacent.

2. The planar inverted F antenna according to claim 1, wherein:

the ground conductive plate is formed into a U-shape in section by being folded at two points, and the main conductive plate is formed into the U-shape in section by being folded at two points on the outer side of the ground conductive plate.

3. The planar inverted F antenna according to claim 1, wherein:

the ground conductive plate is formed into an L-shape in section by being folded at one point, and the main conductive plate is formed into the L-shape in section by being folded at one point on the outer side of the ground conductive plate.

4. The planar inverted F antenna according to claim 1, wherein the main conductive plate is folded at a part corresponding to the one or more of the plurality of slits.

5. The planar inverted F antenna according to claim 1, wherein the ground conductive plate, the short circuiting member and the main conductive plate are integrally formed from one mutually contiguous conductive plate and by being folded in the same direction at a connection part of the ground conducive plate with the short circuiting member and a connection part of the short circuiting member with the main conductive plate.

6. The planar inverted F antenna according to claim 1, wherein the one or the plurality of slits comprises two slits formed at positions equally spaced from both sides of a widthwise center of the main conductive plate, the microstrip line is formed on the center of the main conductive plate, and the one or the plurality of excitation conductive plates comprises a first excitation conductive plate and a second excitation conductive plate formed on the both sides of the main conductive plate, the first and second excitation conductive plates being folded in the same direction at the two slit parts.

7. The planar inverted F antenna according to claim 6, wherein the first excitation conductive plate and the second excitation conductive plate have different lengths.

8. The planar inverted F antenna according to claim 6, wherein the first excitation conductive plate and the second excitation conductive plate are disposed at different distances from the ground conductive plate.

9. The planar inverted F antenna according to claim 1, wherein a through-hole for a feeding line is formed in the ground conductive plate at a position corresponding to an open end of the microstrip line.

10. The planar inverted F antenna according to claim 9, wherein the through-hole for the feeding line is formed into a slit-shape in a longitudinal direction of the microstrip line, and further comprising a plurality of through-holes or a slit-shaped through-hole formed in the microstrip line at a position facing the through-hole for the feeding line.

11. The planar inverted F antenna according to claim 9, wherein the through-hole for the feeding line is formed into a slit-shape in a longitudinal direction of the microstrip line, and further comprising a plurality of grooves formed in the microstrip line at a position facing the through-hole for the feeding line and in a direction intersecting with the longitudinal direction.

12. The planar inverted F antenna according to claim 1, wherein the main conductive plate is folded along a longitudinal direction of the microstrip line.

13. The planar inverted F antenna according to claim 1, wherein the plurality of excitation conductive plates comprises two excitation conductive plates and the plurality of slits comprises two slits; and wherein the microstrip line is spaced apart from the two excitation conductive plates by the respective two slits.

14. The planar inverted F antenna according to claim 1, wherein the position where the input impedance of the antenna becomes Z includes a feeding point to which power is supplied from the feeding line via the microstrip line without requiring direct connection of the feeding line to the feeding point.

15. A planar inverted F antenna comprising:

a ground conductive plate folded at one point or at a plurality of points along a prescribed direction, the ground conductive plate being configured for connection to ground;

a main conductive plate folded at one point or at two points in the same direction as the prescribed direction, the main conductive plate having opposite side ends and being configured for connection to a feeding line for feeding power to the antenna; and a short circuit member for short-circuiting the main conductive plate and the ground conductive plate, the short circuit member having one end connected to the ground conductive plate and another end connected to one of the side ends of the main conductive plate;

wherein the main conductive plate comprises a base extending from the one side end to a prescribed position disposed at a preselected distance in the direction toward the other side end of the main conductive plate, and at least one slit extending from the other side end of the main conductive plate up to the prescribed position to form a microstrip line as a transmission line and to which the feeding line is connected and at least one excitation conductive plate spaced apart from the microstrip line; and wherein the prescribed position includes a feeding point to which power is supplied from the feeding line via the microstrip line which has a width selected so that both an input impedance of the antenna at the feeding point and a characteristic impedance of the transmission line become Z.

16. The planar inverted F antenna according to claim 15, wherein the microstrip line is configured for connection to the feeding line so that power is supplied to the feeding point without requiring direct connection of the feeding line to the feeding point.

17. The inverted F antenna according to claim 15, wherein the preselected distance at which the prescribed position is disposed is equal to a distance between the prescribed position and a position of the connection between the short circuit member and the ground conductive plate.

18. The planar inverted F antenna according to claim 15, wherein the main conductive plate is folded along a longitudinal direction of the microstrip line.

19. The planar inverted F antenna according to claim 15, wherein each of the folded ground conductive plate and the folded main conductive plate is U-shaped in cross-section.

20. The planar inverted F antenna according to claim 15, wherein each of the folded ground conductive plate and the folded main conductive plate is L-shaped in cross-section.

* * * * *